US009890974B2

(12) United States Patent
Yamashita et al.

(10) Patent No.: US 9,890,974 B2
(45) Date of Patent: Feb. 13, 2018

(54) AIR-CONDITIONING APPARATUS

(71) Applicant: Mitsubishi Electric Corporation, Chiyoda-ku, Tokyo (JP)

(72) Inventors: Koji Yamashita, Tokyo (JP); Hiroyuki Morimoto, Tokyo (JP); Yuji Motomura, Tokyo (JP); Takeshi Hatomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 216 days.

(21) Appl. No.: 14/639,560

(22) Filed: Mar. 5, 2015

(65) Prior Publication Data

US 2015/0176864 A1 Jun. 25, 2015

Related U.S. Application Data

(63) Continuation of application No. 13/387,230, filed as application No. PCT/JP2009/065858 on Sep. 10, 2009, now abandoned.

(51) Int. Cl.
*F25B 1/00* (2006.01)
*F24F 3/06* (2006.01)
(Continued)

(52) U.S. Cl.
CPC ..... *F25B 1/00* (2013.01); *F24F 3/06* (2013.01); *F25B 13/00* (2013.01); *F25B 25/005* (2013.01); *F25B 2313/003* (2013.01); *F25B 2313/0231* (2013.01); *F25B 2313/0272* (2013.01); *F25B 2313/02743* (2013.01); *F25B 2500/01* (2013.01); *F25B 2500/19* (2013.01)

(58) Field of Classification Search
CPC ..... F24F 1/06; F24F 1/26; F24F 1/32; F25B 13/00; F25B 5/02; F25B 6/02; F25B 25/005; F25B 7/00
See application file for complete search history.

(56) References Cited

U.S. PATENT DOCUMENTS 2,224,629 A 12/1940 Borse et al.
2,306,704 A 12/1942 Wilhelm
(Continued)

FOREIGN PATENT DOCUMENTS

CN 2416404 Y 1/2001
EP 1 278 026 A1 1/2003
(Continued)

OTHER PUBLICATIONS

Summons to attend oral proceedings pursuant to Rule 115(1) EPC issued Jan. 22, 2016 by the European Patent Office in corresponding European Patent Application No. 09 849 210.1 (5 pages).
(Continued)

*Primary Examiner* — Jianying Atkisson
*Assistant Examiner* — Antonio R Febles
(74) *Attorney, Agent, or Firm* — Buchanan Ingersoll & Rooney PC

(57) ABSTRACT

An air-conditioning apparatus achieves improvement of safety and further achieves saving of energy without allowing a refrigerant to circulate in or near an indoor unit. The air-conditioning apparatus is configured such that heat medium pipes have a larger inner cross-sectional area per unit capacity than that of refrigerant pipes.

6 Claims, 11 Drawing Sheets

(51) Int. Cl.

| | |
|---|---|
| ***F25B 13/00*** | (2006.01) |
| ***F25B 25/00*** | (2006.01) |

(56) References Cited

U.S. PATENT DOCUMENTS

| | | | |
|---|---|---|---|
| 2,797,068 | A | 6/1957 | McFarlan |
| 2,984,458 | A | 5/1961 | McFarlan |
| 5,063,752 | A | 11/1991 | Nakamura et al. |
| 5,461,876 | A | 10/1995 | Dressier |
| 6,880,351 | B2 | 4/2005 | Simadiris et al. |
| 2003/0230107 | A1 | 12/2003 | Lee |
| 2006/0179868 | A1 | 8/2006 | Yoon et al. |
| 2008/0156009 | A1 | 7/2008 | Cur et al. |

FOREIGN PATENT DOCUMENTS

| | | | |
|---|---|---|---|
| EP | 1 698 843 | A2 | 9/2006 |
| EP | 1 703 230 | A2 | 9/2006 |
| EP | 2 034 261 | A1 | 6/2007 |
| JP | 4-006372 | A | 1/1992 |
| JP | 5-280818 | A | 10/1993 |
| JP | 2001-289465 | A | 10/2001 |
| JP | 2002-106995 | A | 4/2002 |
| JP | 2003-343936 | A | 12/2003 |
| JP | 2004-226015 | A | 8/2004 |
| JP | 2005-140444 | A | 6/2005 |
| JP | 2005-351600 | A | 12/2005 |
| JP | 2006-003079 | A | 1/2006 |
| JP | 2008-032275 | A | 2/2008 |
| WO | WO 2008/013105 | A1 | 1/2008 |

OTHER PUBLICATIONS

Decision to Refuse a European Patent Application dated Sep. 9, 2016, by the European Patent Office in corresponding European Patent Application No. 09 849 210.1 (13 pages).

Office Action dated Apr. 21, 2015, by the Chinese Patent Office in corresponding Chinese Patent Application No. 200980161355.6 and an English translation of the Office Action. (14 pages).

International Search Report (PCT/ISA/210) dated Dec. 22, 2009, by Japanese Patent Office as the International Searching Authority for International Application No. PCT/JP2009/065858.

Japanese Office Action (Notice of Reasons for Rejection) dated Aug. 14, 2012, issued in corresponding Japanese Patent Application 2011-530685. (4 Pages).

Office Action (Notification of the First Office Action) dated Aug. 26, 2013, by the Chinese Patent Office in corresponding Chinese Patent Application No. 200980161355.6, and an English Translation of the Office Action. (11 pages).

Office Action dated Mar. 10, 2014, by the Chinese Patent Office in corresponding Chinese Patent Application No. 200980161355.6 and an English translation of the Office Action. (10 pages).

Extended European Search Report dated Jun. 3, 2014, issued by the European Patent Office in corresponding European Patent Application No. 09849210.1-1602/2472199. (7 pages).

Chinese Office Action (Text Portion of the Decision of Rejection) dated Jul. 16, 2014, by the Chinese Patent Office in corresponding Chinese Application No. 200980161355.6, and an English translation of the Office Action. (12 pages).

Office Action dated May 5, 2015, issued by the European Patent Office in the corresponding European Application No. 09849210.1. (4 pages).

The extended European Search Report dated Sep. 29, 2017, by the European Patent Office on corresponding European Patent Application No. 17152214.7 - 1602. (6 pages).

AIR-CONDITIONING APPARATUS

TECHNICAL FIELD

The present invention relates to an air-conditioning apparatus which is applied to, for example, a multi-air-conditioning apparatus for a building.

BACKGROUND ART

In an air-conditioning apparatus, such as a multi-air-conditioning apparatus for a building, a refrigerant is circulated between an outdoor unit, functioning as a heat source unit, disposed outside a structure and an indoor unit disposed inside an indoor space of the structure, for example. The refrigerant rejects or receives heat, and with the heated or cooled air, heats or cools a conditioned space. As regards the refrigerant, for example, HFC (hydrofluorocarbon) is often used. An air-conditioning apparatus using a natural refrigerant, such as carbon dioxide ($CO_2$), has also been proposed.

Furthermore, in an air-conditioning apparatus called a chiller, cooling energy or heating energy is generated in a heat source unit disposed outside a structure. Water, antifreeze, or the like is heated or cooled by a heat exchanger disposed in an outdoor unit and is carried to an indoor unit, such as a fan coil unit or a panel heater, for heating or cooling (refer to Patent Literature 1, for example).

Moreover, an air-conditioning apparatus called a waste heat recovery chiller is constructed such that a heat source unit and each indoor unit are connected through four water pipes arranged therebetween and, for example, cooled water and heated water are simultaneously supplied so that cooling or heating can be freely selected in the indoor unit (refer to Patent Literature 2, for example).

Furthermore, an air-conditioning apparatus is constructed such that a heat exchanger for a primary refrigerant and a secondary refrigerant is disposed near each indoor unit to carry the secondary refrigerant to the indoor unit (refer to Patent Literature 3, for example).

Furthermore, an air-conditioning apparatus is constructed such that an outdoor unit is connected to each branching unit including a heat exchanger through two pipes to carry a secondary refrigerant to an indoor unit (refer to Patent Literature 4, for example).

CITATION LIST

Patent Literature

Patent Literature 1: Japanese Unexamined Patent Application Publication No. 2005-140444 (Page 4, FIG. 1, for example)

Patent Literature 2: Japanese Unexamined Patent Application Publication No. 5-280818 (Pages 4, 5, FIG. 1, for example)

Patent Literature 3: Japanese Unexamined Patent Application Publication No. 2001-289465 (Pages 5 to 8, FIGS. 1 and 2, for example)

Patent Literature 4: Japanese Unexamined Patent Application Publication No. 2003-343936 (Page 5, FIG. 1)

SUMMARY OF INVENTION

Technical Problem

In an air-conditioning apparatus of a related-art, such as a multi-air-conditioning apparatus for a building, because a refrigerant is circulated up to an indoor unit, the refrigerant may leak into, for example, an indoor space. In such air-conditioning apparatuses disclosed in Patent Literature 1 and Patent Literature 2, the refrigerant does not pass through the indoor unit. However, in the air-conditioning apparatuses disclosed in Patent Literature 1 and Patent Literature 2, the heat medium is heated or cooled in a heat source unit disposed outside a structure and needs to be conveyed to the indoor unit. Accordingly, a circulation path for the heat medium is long. In this case, to carry heat for a predetermined heating or cooling work using the heat medium, the amount of energy consumed as conveyance power is larger than that used by the refrigerant. As the circulation path becomes longer, the conveyance power becomes markedly large. This indicates that energy saving is achieved if the circulation of the heat medium can be properly controlled in the air-conditioning apparatus.

In the air-conditioning apparatus disclosed in Patent Literature 2, the four pipes have to be arranged to connect each indoor unit to an outdoor unit so that cooling or heating can be selected in each indoor unit. Disadvantageously, ease of construction is poor. In the air-conditioning apparatus disclosed in Patent Literature 3, secondary medium circulating means, such as a pump, has to be provided in each indoor unit. Disadvantageously, the cost of such a system is high and noise is also high, and thus the apparatus is not practical. Furthermore, since the heat exchanger is placed near each indoor unit, the risk of leakage of the refrigerant into a place near an indoor space cannot be eliminated.

In the air-conditioning apparatus disclosed in Patent Literature 4, a primary refrigerant that has heat exchanged flows into the same path as that for the primary refrigerant before heat exchange. Accordingly, in the case in which a plurality of indoor units is connected, it is difficult for each indoor unit to exhibit its maximum capacity. Such configuration wastes energy. Furthermore, each branching unit is connected to an extension pipe through two pipes for cooling and two pipes for heating, i.e., four pipes in total. Consequently, this configuration is similar to that of a system in which the outdoor unit is connected to each branching unit through four pipes. Accordingly, the ease of construction of such system is poor.

The present invention has been made to overcome the above-described problem and a first object of the invention is to provide an air-conditioning apparatus that exhibits improved safety without the circulation of a refrigerant in or near an indoor unit and furthermore achieves energy saving. Furthermore to the first object, a second object of the invention is to provide an air-conditioning apparatus that achieves improved ease of construction and improved energy efficiency by reducing the number of pipes connecting an outdoor unit to a branching unit or indoor unit.

Solution to Problem

An air-conditioning apparatus according to the invention includes at least a compressor; a heat source side heat exchanger; an expansion device; a heat exchanger related to heat medium; a pump; and a use side heat exchanger, the compressor, the heat source side heat exchanger, the expansion device, and the heat exchanger related to heat medium being connected with refrigerant pipes to form a refrigerant circuit in which a heat-source-side refrigerant is circulated, the pump, the use side heat exchanger, and the heat exchanger related to heat medium being connected with heat medium pipes to form a heat medium circuit in which a heat medium is circulated, the compressor and the heat source side heat exchanger being housed in an outdoor unit, the expansion device, the heat exchanger related to heat medium, and the pump being housed in a relay unit, the use side heat exchanger being housed in an indoor unit, heat being exchanged between the heat-source-side refrigerant and the heat medium in the heat exchanger related to heat medium, in which the heat medium pipes have a larger inner cross-sectional area per unit capacity than that of the refrigerant pipes.

Advantageous Effects of Invention

The air-conditioning apparatus according to the invention allows a reduction in the length of pipes through which the heat medium circulates, so that less conveyance power is required. Advantageously, safety can be improved and energy saving can be achieved. Furthermore, the air-conditioning apparatus according to the invention retards corrosion of pipes, thus contributing to long-term energy saving.

DESCRIPTION OF EMBODIMENT

The Embodiment of the invention will be described below with reference to the drawings.

Figure 1:
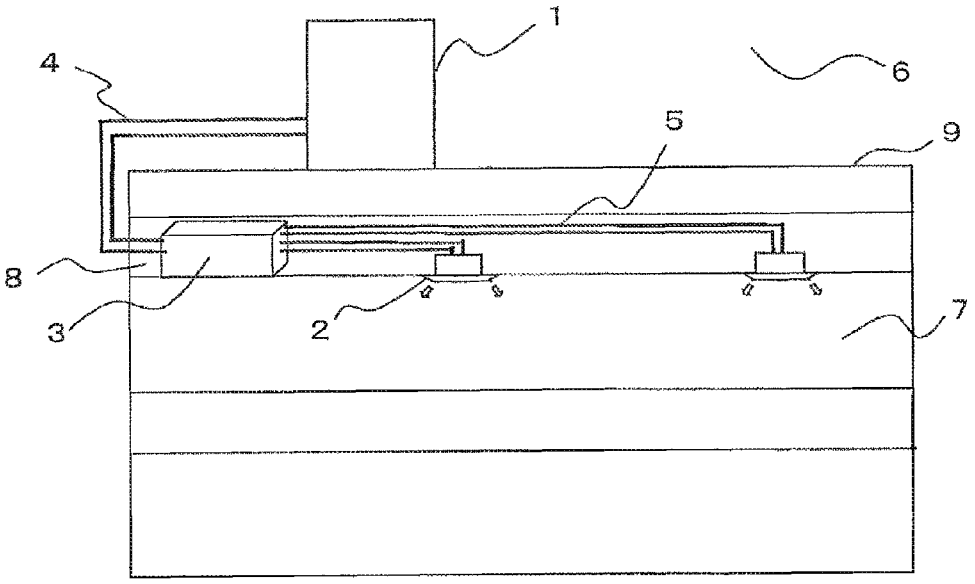
FIG. 1 is a schematic diagram illustrating an installation of an air-conditioning apparatus according to the Embodiment of the invention.
Figure 2:
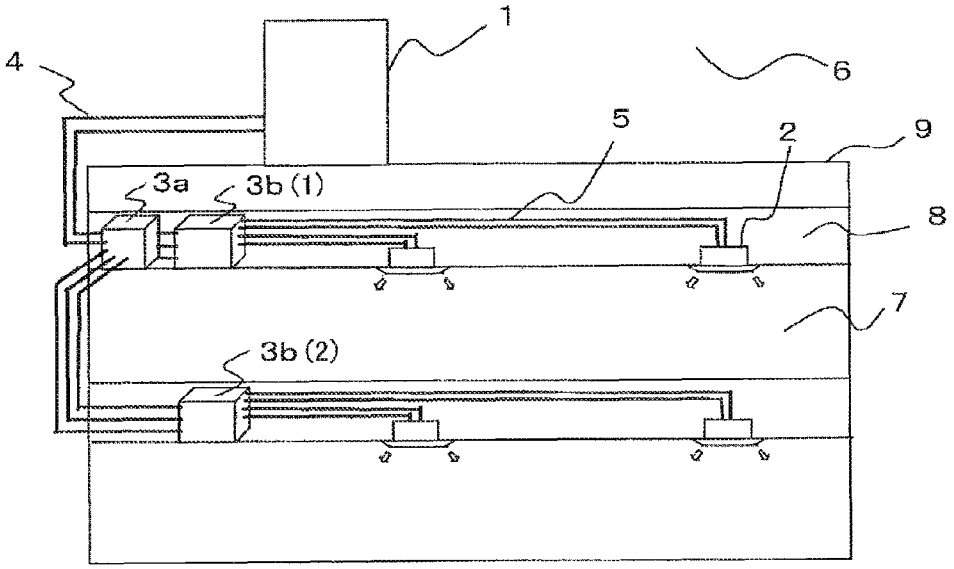
FIG. 2 is a schematic diagram illustrating an installation of the air-conditioning apparatus according to the Embodiment of the invention.

FIGS. 1 and 2 are schematic diagrams illustrating installations of an air-conditioning apparatus according to the Embodiment of the invention. The installations of the air-conditioning apparatus will be described with reference to FIGS. 1 and 2. This air-conditioning apparatus uses refrigeration cycles (a refrigerant circuit A, heat medium circuit B) in each of which a refrigerant (a heat-source-side refrigerant or a heat medium) is circulated such that a cooling mode or a heating mode can be freely selected as an operation mode in each indoor unit. Furthermore, the dimensional relationship among components in the below figures including FIG. 1 may be different from the actual ones.

Referring to FIG. 1, the air-conditioning apparatus according to the Embodiment includes an outdoor unit 1, which is a heat source unit, a plurality of indoor units 2, and a relay unit 3 disposed between the outdoor unit 1 and the indoor units 2. The relay unit 3 exchanges heat between the heat-source-side refrigerant and the heat medium. The outdoor unit 1 is connected to the relay unit 3 via refrigerant pipes 4 through which the heat-source-side refrigerant is conveyed. The relay unit 3 is connected to each indoor unit 2 via pipes (heat medium pipes) 5 through which the heat medium is conveyed. Cooling energy or heating energy generated in the outdoor unit 1 is delivered through the relay unit 3 to the indoor units 2.

Referring to FIG. 2, the air-conditioning apparatus according to the Embodiment includes an outdoor unit 1, a plurality of indoor units 2, a plurality of separated relay units 3 (a main relay unit 3*a*, sub relay units 3*b*) arranged between the outdoor unit 1 and the indoor units 2. The outdoor unit 1 is connected to the main relay unit 3*a* through the refrigerant pipes 4. The main relay unit 3*a* is connected to the sub relay units 3*b* through the refrigerant pipes 4. Each sub relay unit 3*b* is connected to the indoor units 2 through the pipes 5. Cooling energy or heating energy generated in the outdoor unit 1 is delivered through the main relay unit 3*a* and the sub relay units 3*b* to the indoor units 2.

The outdoor unit 1 typically disposed in an outdoor space 6 which is a space (e.g., a roof) outside a structure 9, such as a building supplies cooling energy or heating energy through the relay units 3 to the indoor unit 2. Each indoor unit 2 is disposed in a position where cooling air or heating air can be supplied to an indoor space 7, which is a space (e.g., a living room) inside the structure 9, and is configured to supply the cooling air or heating air to the indoor space 7, which is an air conditioning space. Each relay unit 3 is configured so that it can be disposed in a position different from those of the outdoor space 6 and the indoor space 7, as a housing separate from the housings of the outdoor unit 1 and the indoor units 2. Each relay unit 3 is connected to the outdoor unit 1 through the refrigerant pipes 4 and is connected to the indoor units 2 through the pipes 5 to transfer cooling energy or heating energy, supplied from the outdoor unit 1, to the indoor units 2.

As illustrated in FIGS. 1 and 2, in the air-conditioning apparatus according to Embodiment, the outdoor unit 1 is connected to the relay unit 3 using two refrigerant pipes 4 and the relay unit 3 is connected to each indoor unit 2 using two pipes 5. As described above, in the air-conditioning apparatus according to the Embodiment, each unit (outdoor unit 1, indoor unit 2, and relay unit 3) is connected using two pipes (the refrigerant pipes 4 or the pipes 5), thus facilitating construction.

As illustrated in FIG. 2, the relay unit 3 can be separated into a main relay unit 3*a* and two sub relay units 3*b* (a sub relay unit 3*b*(1), a sub relay unit 3*b*(2)) derived from the main relay unit 3*a*. This separation allows a plurality of sub relay units 3*b* to be connected to a main relay unit 3*a*. In this configuration, the number of refrigerant pipes 4 connecting the main relay unit 3*a* to each sub relay unit 3*b* is three. Such a circuit will be described in detail later (refer to FIG. 3A).

It should be noted that FIGS. 1 and 2 illustrate a state in which the relay unit 3 is disposed in a space different from the indoor space 7 such as a space above a ceiling (hereinafter, simply referred to as "space 8") inside the structure 9. The relay unit 3 can be placed in other spaces, e.g., a common space where an elevator is installed. Furthermore, although FIGS. 1 and 2 illustrate a case in which the indoor units 2 are of a ceiling-mounted cassette type, the indoor units are not limited to this type and, for example, a ceiling-concealed type, a ceiling-suspended type, or any indoor unit may be used as long as the unit can blow out heating air or cooling air into the indoor space 7 directly or through a duct or the like.

FIGS. 1 and 2 illustrate a case in which the outdoor unit 1 is disposed in the outdoor space 6. The arrangement is not limited to this case. For example, the outdoor unit 1 may be disposed in an enclosed space with a ventilation opening, for example, a machine room, and may be disposed inside the structure 9 as long as waste heat can be exhausted through an exhaust duct to the outside of the structure 9, or may be disposed inside the structure 9 when using an outdoor unit 1 of a water-cooled type. Even when the outdoor unit 1 is disposed in such a place, no problems in particular will occur.

Furthermore, the relay unit 3 can be disposed near the outdoor unit 1. If the distance between the relay unit 3 and each indoor unit 2 is too far, the conveyance power for the heat medium will be considerably large. It should therefore be noted that the energy saving effect will be reduced in this case. Furthermore, the connected numbers of the outdoor unit 1, indoor unit 2, and the relay unit 3 are not limited to the numbers illustrated in FIGS. 1 and 2. The numbers may be determined depending on the structure 9 in which the air-conditioning apparatus according to the Embodiment is installed.

Figure 3:
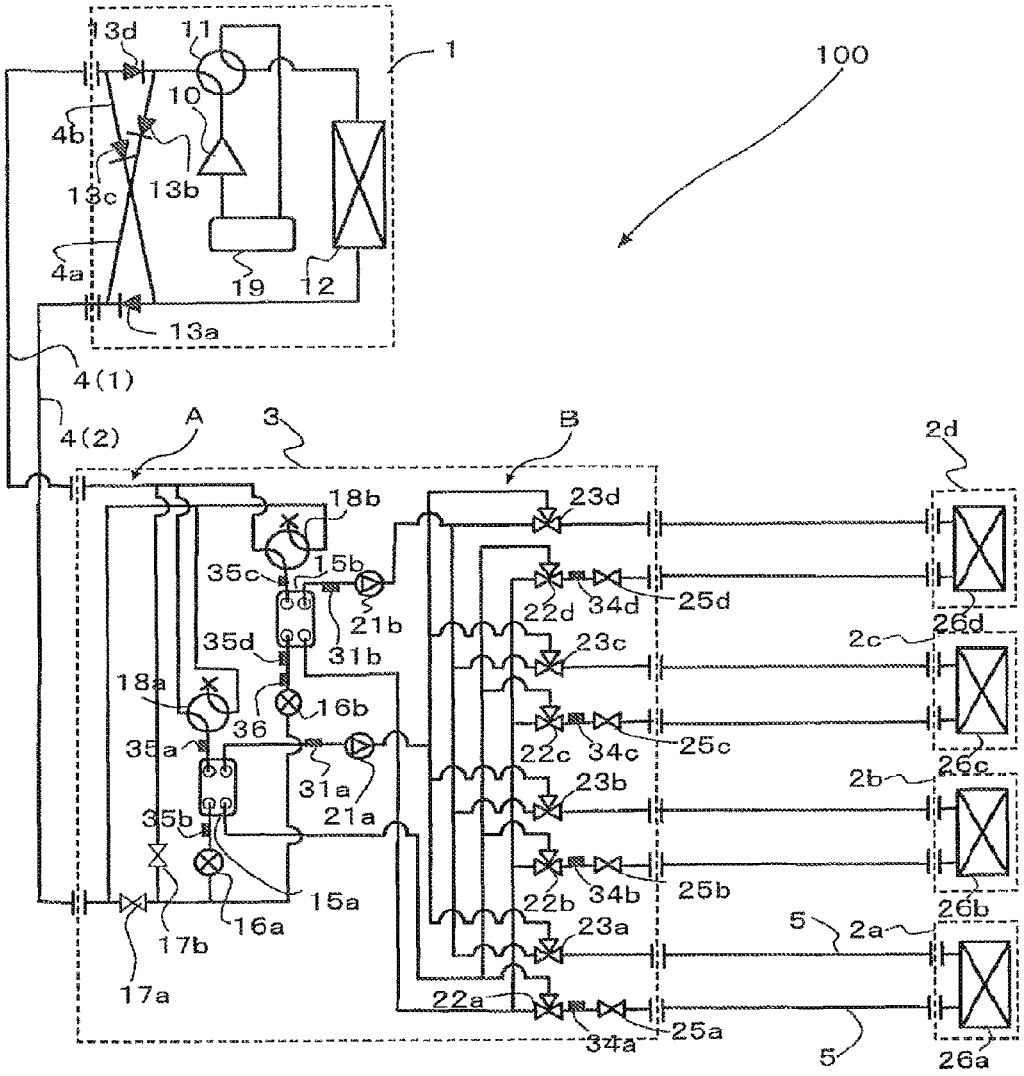
FIG. 3 is a schematic circuit diagram illustrating a circuit configuration of the air-conditioning apparatus according to the Embodiment of the invention.

FIG. 3 is a schematic circuit diagram illustrating an exemplary circuit configuration of the air-conditioning apparatus (hereinafter, referred to as "air-conditioning apparatus 100") according to the Embodiment. The detailed configuration of the air-conditioning apparatus 100 will be described with reference to FIG. 3. Referring to FIG. 3, the outdoor unit 1 and the relay unit 3 are interconnected with the refrigerant pipes 4 via a heat exchanger related to heat medium 15*a* and a heat exchanger related to heat medium 15*b* provided in the relay unit 3. Furthermore, the relay unit 3 and the indoor units 2 are interconnected with the pipes 5 via the heat exchanger related to heat medium 15*a* and the heat exchanger related to heat medium 15*b*. The refrigerant pipes 4 will be described later.

[Outdoor Unit 1]

The outdoor unit 1 includes a compressor 10, a first refrigerant flow switching device 11, such as a four-way valve, a heat source side heat exchanger 12, and an accumulator 19 which are connected in series through the refrigerant pipe 4. The outdoor unit 1 further includes a first connecting pipe 4*a*, a second connecting pipe 4*b*, a check valve 13*a*, a check valve 13*b*, a check valve 13*c*, and a check valve 13*d*. Such arrangement of the first connecting pipe 4*a*, the second connecting pipe 4*b*, the check valve 13*a*, the check valve 13*b*, the check valve 13*c*, and the check valve 13*d* allows the heat-source-side refrigerant, allowed to flow into the relay unit 3, to flow in a constant direction irrespective of the operations requested by the indoor units 2.

The compressor 10 sucks the heat-source-side refrigerant and compresses the heat-source-side refrigerant to a high-temperature high-pressure state, and may be an inverter type variable capacity compressor, for example. The first refrigerant flow switching device 11 is configured to switch between a refrigerant flow on the heat-source-side for a heating operation (including a heating only operation mode and a heating-main operation mode) and a refrigerant flow on the heat-source-side for a cooling operation (including a cooling only operation mode and a cooling-main operation mode). The heat source side heat exchanger 12 is configured to function as an evaporator when in the heating operation, function as a condenser (or a radiator) when in the cooling operation, exchange heat between air supplied from an air-blowing device, such as a fan, (not illustrated) and the heat-source-side refrigerant, and evaporate and gasify the heat-source-side refrigerant or condense and liquefy the same. The accumulator 19 is disposed on a suction side of the compressor 10 and is configured to store excess refrigerant.

The check valve 13*d* is provided in the refrigerant pipe 4 between the relay unit 3 and the first refrigerant flow switching device 11 and is configured to allow the heat-source-side refrigerant to flow only in a predetermined direction (the direction from the relay unit 3 to the outdoor unit 1). The check valve 13*a* is provided in the refrigerant pipe 4 between the heat source side heat exchanger 12 and the relay unit 3 and is configured to allow the heat-source-side refrigerant to flow only in a predetermined direction (the direction from the outdoor unit 1 to the relay unit 3). The check valve 13*b* is provided in the first connecting pipe 4*a* and is configured to allow the heat-source-side refrigerant, discharged from the compressor 10 during the heating operation, to flow through the relay unit 3. The check valve 13*c* is provided in the second connecting pipe 4*b* and is configured to allow the heat-source-side refrigerant, returned from the relay unit 3 during the heating operation, to flow to the suction side of the compressor 10.

The first connecting pipe 4*a*, in the outdoor unit 1, is configured to connect the refrigerant pipe 4 between the first refrigerant flow switching device 11 and the check valve 13*d* to the refrigerant pipe 4 between the check valve 13*a* and the relay unit 3. The second connecting pipe 4*b*, in the outdoor unit 1, is configured to connect the refrigerant pipe 4 between the check valve 13*d* and the relay unit 3 to the refrigerant pipe 4 between the heat source side heat exchanger 12 and the check valve 13*a*. It should be noted that although FIG. 3 illustrates a case in which the first connecting pipe 4*a*, the second connecting pipe 4*b*, the check valve 13*a*, the check valve 13*b*, the check valve 13*c*, and the check valve 13*d* are arranged, the arrangement is not limited to this case. It is not always essential to provide these components.

[Indoor Units 2]

The indoor units 2 each include a use side heat exchanger 26. This use side heat exchanger 26 is connected to a heat medium flow rate control device 25 and a second heat medium flow switching device 23 in the relay unit 3 through the pipes 5. This use side heat exchanger 26 is configured to exchange heat between air supplied from an air-blowing device, such as a fan, (not illustrated) and the heat medium to produce heating air or cooling air to be supplied to the indoor space 7.

FIG. 3 illustrates a case in which four indoor units 2 are connected to the relay unit 3. Illustrated, from the bottom of the drawing sheet, are an indoor unit 2*a*, an indoor unit 2*b*, an indoor unit 2*c*, and an indoor unit 2*d*. Furthermore, corresponding to the indoor units 2*a* to 2*d*, the use side heat exchangers 26 are illustrated, from the bottom of the drawing sheet, as a use side heat exchanger 26*a*, a use side heat exchanger 26*b*, a use side heat exchanger 26*c*, and a use side heat exchanger 26*d*. Note that, in the same manner as in FIGS. 1 and 2, the number of indoor units 2 connected is not limited to four as illustrated in FIG. 3.

[Relay Unit 3]

The relay unit 3 includes the two heat exchangers related to heat medium 15, two expansion devices 16, two opening and closing devices 17, two second refrigerant flow switching devices 18, two pumps 21, four first heat medium flow switching devices 22, the four second heat medium flow switching devices 23, and the four heat medium flow rate control devices 25. Furthermore, a configuration in which the relay unit 3 is separated into the main relay unit 3*a* and the sub relay unit 3*b* will be described later with reference to FIG. 3A.

Each of the two heat exchangers related to heat medium 15 (the heat exchanger related to heat medium 15*a*, the heat exchanger related to heat medium 15*b*) is configured to function as a condenser (radiator) or an evaporator and to exchange heat between the heat-source-side refrigerant and the heat medium and transfer cooling energy or heating energy, generated by the outdoor unit 1 and stored in the heat-source-side refrigerant, to the heat medium. The heat exchanger related to heat medium 15*a* is disposed between the expansion device 16*a* and the second refrigerant flow switching device 18*a* in a refrigerant circuit A and is used to cool the heat medium in a cooling and heating mixed operation mode. On the other hand, the heat exchanger related to heat medium 15*b* is disposed between the expansion device 16*b* and the second refrigerant flow switching device 18*b* in the refrigerant circuit A and is used to heat the heat medium in the cooling and heating mixed operation mode.

The two expansion devices 16 (expansion device 16*a*, expansion device 16*b*) each have functions of a reducing valve and an expansion valve and are configured to reduce the pressure of the heat-source-side refrigerant and expand the same. The expansion device 16*a* is disposed upstream of the heat exchanger related to heat medium 15*a* in the flow direction of the heat-source-side refrigerant during the cooling operation. The expansion device 16*b* is disposed upstream of the heat exchanger related to heat medium 15*b* in the flow direction of the heat-source-side refrigerant during the cooling operation. The two expansion devices 16 may be constituted by a component having a variably controllable opening-degree, e.g., an electronic expansion valve.

Each of the two opening and closing devices 17 (opening and closing device 17*a*, opening and closing device 17*b*) is constituted by, for example, a two-way valve and is configured to open and close the refrigerant pipes 4. The opening and closing device 17*a* is provided in the refrigerant pipe 4 on an inlet side of the heat-source-side refrigerant. The opening and closing device 17*b* is provided in a pipe connecting the refrigerant pipes 4 on the inlet side and the outlet side of the heat-source-side refrigerant. Each of the two second refrigerant flow switching devices 18 (second refrigerant flow switching device 18*a*, second refrigerant flow switching device 18*b*) is constituted by, for example, a four-way valve and is configured to switch the flow direction of the heat-source-side refrigerant in accordance with an operation mode. The second refrigerant flow switching device 18*a* is disposed downstream of the heat exchanger related to heat medium 15*a* in the flow direction of the heat-source-side refrigerant during the cooling operation. The second refrigerant flow switching device 18*b* is disposed downstream of the heat exchanger related to heat medium 15*b* in the flow direction of the heat-source-side refrigerant during a cooling only operation.

The two pumps 21 (pump 21*a*, pump 21*b*) are configured to circulate the heat medium flowing through the pipe 5. The pump 21*a* is provided in the pipe 5 disposed between the heat exchanger related to heat medium 15*a* and each of the second heat medium flow switching devices 23. The pump 21*b* is provided in the pipe 5 disposed between the heat exchanger related to heat medium 15*b* and each of the second heat medium flow switching devices 23. Each of the two pumps 21 may be constituted by, for example, a capacity-controllable pump.

Each of the four first heat medium flow switching devices 22 (first heat medium flow switching devices 22*a* to 22*d*) is constituted by, for example, a three-way valve and is configured to switch the flow paths of the heat medium. The first heat medium flow switching devices 22 are arranged so that their number (four in this case) corresponds to the number of indoor units 2 installed. Each first heat medium flow switching device 22 is disposed in a corresponding flow path of the heat medium on the outlet side of a use side heat exchanger 26. Out of the three ways, one is connected to the heat exchanger related to heat medium 15*a*, another one is connected to the heat exchanger related to heat medium 15*b*, and the other one is connected to the heat medium flow rate control device 25. Furthermore, corresponding to the indoor units 2 and illustrated from the bottom of the drawing sheet are the first heat medium flow switching device 22*a*, the first heat medium flow switching device 22*b*, the first heat medium flow switching device 22*c*, and the first heat medium flow switching device 22*d*.

Each of the four second heat medium flow switching devices 23 (second heat medium flow switching devices 23*a* to 23*d*) is constituted by, for example, a three-way valve and is configured to switch the flow paths of the heat medium. The second heat medium flow switching devices 23 are arranged so that their number (four in this case) corresponds to the number of indoor units 2 installed. The second heat medium flow switching devices 23 are arranged so that their number (four in this case) corresponds to the number of indoor units 2 installed. Each first heat medium flow switching device 23 is disposed in a corresponding flow path of the heat medium on the inlet side of a use side heat exchanger 26. Out of the three ways, one is connected to the heat exchanger related to heat medium 15*a*, another one is connected to the heat exchanger related to heat medium 15*b*, and the other one is connected to the heat medium flow rate control device 26. Furthermore, corresponding to the indoor units 2 and illustrated from the bottom of the drawing sheet are the second heat medium flow switching device 23*a*, the second heat medium flow switching device 23*b*, the second heat medium flow switching device 23*c*, and the second heat medium flow switching device 23*d*.

Each of the four heat medium flow rate control devices 25 (heat medium flow rate control devices 25*a* to 25*d*) is constituted by, for example, a two-way valve using a stepping motor and is configured to permit the opening-degree of the pipe 5, serving as a heat medium flow path, to be changed and control the flow rate of the heat medium. The heat medium flow rate control devices 25 are arranged so that their number (four in this case) corresponds to the number of indoor units 2 installed. Each heat medium flow rate control device 25 is disposed in a corresponding flow path of the heat medium on the outlet side of a use side heat exchanger 26 and one way thereof is connected to the use side heat exchanger 26 and the other way is connected to the first heat medium flow switching device 22. Furthermore, corresponding to the indoor units 2 and illustrated from the bottom of the drawing sheet are the heat medium flow rate control device 25*a*, the heat medium flow rate control device 25*b*, the heat medium flow rate control device 25*c*, and the heat medium flow rate control device 25*d*. Moreover, each heat medium flow rate control device 25 may be disposed in the flow path of the heat medium on the inlet side of a use side heat exchanger 26.

The relay unit 3 further includes various detecting means (two first temperature sensors 31, four second temperature sensors 34, four third temperature sensors 35, and a pressure sensor 36). Information (temperature information, pressure information) detected by these detecting means are transmitted to a controller (not illustrated) that performs centralized control of an operation of the air-conditioning apparatus 100, and are used to control, for example, the driving frequency of the compressor 10, the rotation speed of the fan (not illustrated), switching of the first refrigerant flow switching device 11, the driving frequency of the pumps 21, switching of the second refrigerant flow switching devices 18, and switching the flow paths of the heat medium.

Each of the two first temperature sensors 31 (first temperature sensor 31*a*, first temperature sensor 31*b*) is configured to detect the temperature of the heat medium flowing out of the heat exchanger related to heat medium 15, that is, the temperature of the heat medium at an outlet of the heat exchanger related to heat medium 15 and may be constituted by, for example, a thermistor. The first temperature sensor 31*a* is provided in the pipe 5 on an inlet side of the pump 21*a*. The first temperature sensor 31*b* is provided in the pipe 5 on an inlet side of the pump 21*b*.

Each of the four second temperature sensors 34 (second temperature sensors 34*a* to 34*d*) is disposed between the first heat medium flow switching device 22 and the heat medium flow rate control device 25 and is configured to detect the temperature of the heat medium flowing out of the use side heat exchanger 26 and may be constituted by, for example, a thermistor. The second temperature sensors 34 are arranged so that their number (four in this case) corresponds to the number of indoor units 2 installed. Furthermore, corresponding to the indoor units 2 and illustrated from the bottom of the drawing sheet are the second temperature sensor 34*a*, the second temperature sensor 34*b*, the second temperature sensor 34*c*, and the second temperature sensor 34*d*.

Each of the four third temperature sensors 35 (third temperature sensors 35*a* to 35*d*) is disposed on a heat-source-side refrigerant inlet side or outlet side of the heat exchanger related to heat medium 15 and is configured to detect the temperature of the heat-source-side refrigerant flowing into the heat exchanger related to heat medium 15, or the temperature of the heat-source-side refrigerant flowing out of the heat exchanger related to heat medium 15 and may be constituted by, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat-source-side refrigerant flowing between the heat exchanger related to heat medium 15*b* and the expansion device 16*b*.

Furthermore, the controller (not illustrated) is constituted by, for example, a microcomputer and controls, for example, the driving frequency of the compressor 10, the rotation speed (including ON/OFF) of the fan, switching of the first refrigerant flow switching device 11, driving the pumps 21, the opening-degree of each expansion device 16, the opening-degree of each opening and closing device 17, switching of the second refrigerant flow switching devices 18, switching of the first heat medium flow switching devices 22, switching of the second heat medium flow switching devices 23, and running the heat medium flow rate control devices 25 on the basis of the information detected by the various detecting means and an instruction from a remote-controlling device to carry out any one of the operation modes which will be described later. Note that the controller may be provided in each unit or may be provided in the outdoor unit 1 or the relay unit 3.

The pipes 5 for conveying the heat medium is constituted by the pipe connected to the heat exchanger related to heat medium 15*a* and the pipe connected to the heat exchanger related to heat medium 15*b*. Each pipe 5 is branched (into four in this case) in accordance with the number of indoor units 2 connected to the relay unit 3. The pipes 5 are connected through the first heat medium flow switching devices 22 and the second heat medium flow switching devices 23. Control of the first heat medium flow switching devices 22 and the second heat medium flow switching devices 23 determines whether the heat medium flowing from the heat exchanger related to heat medium 15*a* is allowed to flow into the use side heat exchanger 26 and whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant flow path of the heat exchanger related to heat medium 15*a*, the expansion devices 16, and the accumulator 19 are connected though the refrigerant pipes 4, thus forming the refrigerant circuit A. Furthermore, a heat medium flow path of the heat exchanger related to heat medium 15*a*, the pumps 21, the first heat medium flow switching devices 22, the heat medium flow rate control devices 25, the use side heat exchangers 26, and the second heat medium flow switching devices 23 are connected through the pipes 5, thus forming a heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the relay unit 3 are connected through the heat exchanger related to heat medium 15*a* and the heat exchanger related to heat medium 15*b* arranged in the relay unit 3. The relay unit 3 and each indoor unit 2 are connected through the heat exchanger related to heat medium 15*a* and the heat exchanger related to heat medium 15*b*. In other words, in the air-conditioning apparatus 100, the heat-source-side refrigerant circulating in the refrigerant circuit A and the heat medium circulating in the heat medium circuit B exchanges heat at the heat exchanger related to heat medium 15*a* and the heat exchanger related to heat medium 15*b*.

Figure 3A:
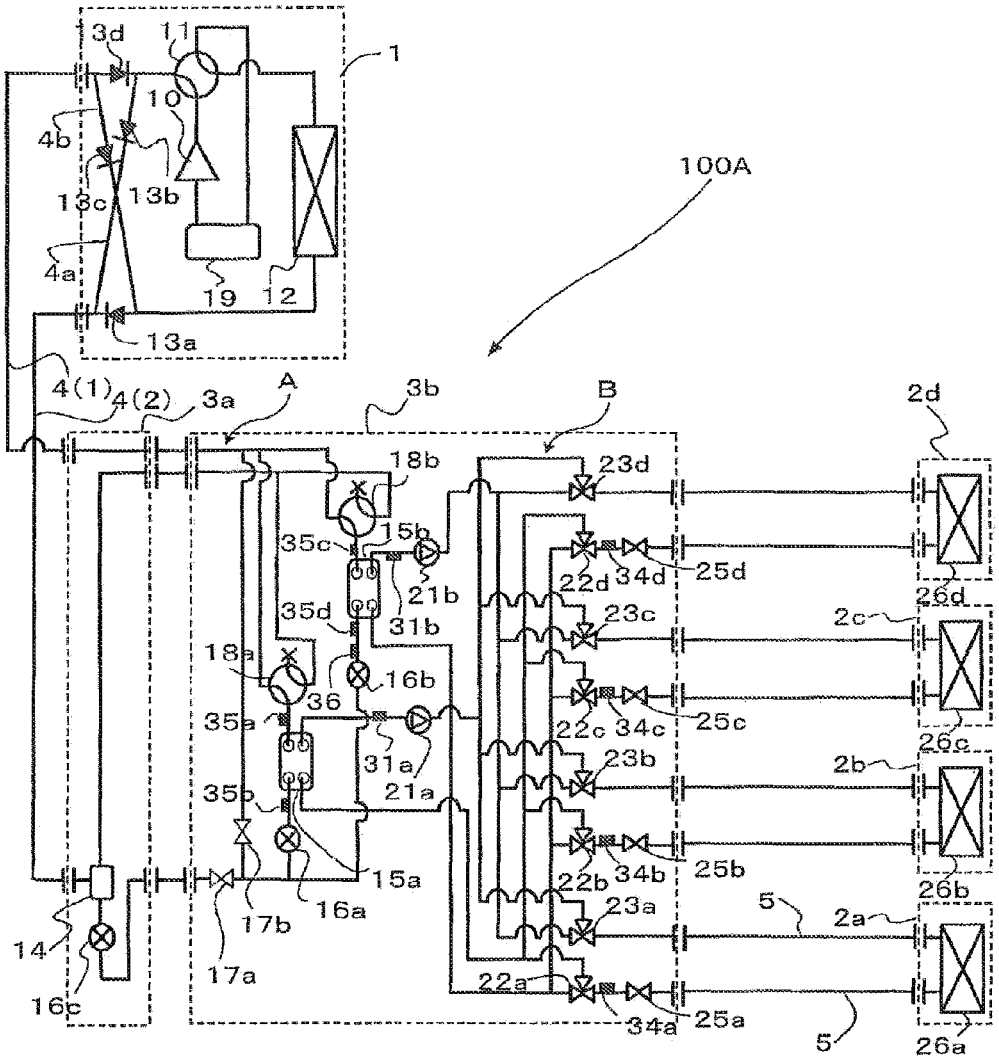
FIG. 3A is a schematic circuit diagram illustrating another circuit configuration of the air-conditioning apparatus according to the Embodiment of the invention.

FIG. 3A is a schematic circuit diagram illustrating another exemplary circuit configuration of an air-conditioning apparatus (hereinafter, referred to as an "air-conditioning apparatus 100A") according to the Embodiment. A circuit configuration of the air-conditioning apparatus 100A in the case in which a relay unit 3 is separated into a main relay unit 3*a* and a sub relay unit 3*b* will be described with reference to FIG. 3A. Referring to FIG. 3A, the relay unit 3 is separated into a housed main relay unit 3*a* and a housed sub relay unit 3*b*. This separation allows a plurality of sub relay units 3*b* to be connected to one main relay unit 3*a* as illustrated in FIG. 2.

The main relay unit 3*a* includes a gas-liquid separator 14 and an expansion device 16*c*. The other components are arranged in the sub relay unit 3*b*. The gas-liquid separator 14 is connected to a refrigerant pipe 4 connected to an outdoor unit 1 and is connected to two refrigerant pipes 4 connected to a heat exchanger related to heat medium 15*a* and a heat exchanger related to heat medium 15*b* in the sub relay unit 3*b*, and is configured to separate the heat-source-side refrigerant supplied from the outdoor unit 1 into a vapor refrigerant and a liquid refrigerant. The expansion device 16*c*, disposed downstream in the flow direction of the liquid refrigerant flowing out of the gas-liquid separator 14, has functions of a reducing valve and an expansion valve and is configured to reduce the pressure of the heat-source-side refrigerant and expand the same. During a cooling and heating mixed operation, the expansion device 16*c* is controlled such that the pressure condition of the refrigerant on an outlet side of the expansion device 16*c* is at medium pressure. The expansion device 16*c* may be constituted by a component having a variably controllable opening-degree, e.g., an electronic expansion valve. This arrangement allows a plurality of sub relay units 3*b* to be connected to the main relay unit 3*a*.

The operation modes carried out by the air-conditioning apparatus 100 will be described. The air-conditioning apparatus 100 can perform cooling operation or heating operation on the basis of instructions from the indoor units 2. That is, the air-conditioning apparatus 100 can have all of the indoor units 2 perform the same operation and also have the indoor units 2 perform different operations. The same applies to operation modes carried out by the air-conditioning apparatus 100A. Accordingly, description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 includes the cooling only operation mode in which all of the running indoor units 2 perform the cooling operation, the heating only operation mode in which all of the running indoor units 2 perform the heating operation, the cooling-main operation mode in which a cooling load is larger, and the heating-main operation mode in which a heating load is larger. Each operation mode will be described below with respect to the flow of the heat-source-side refrigerant and that of the heat medium.

[Cooling Only Operation Mode]

Figure 4:
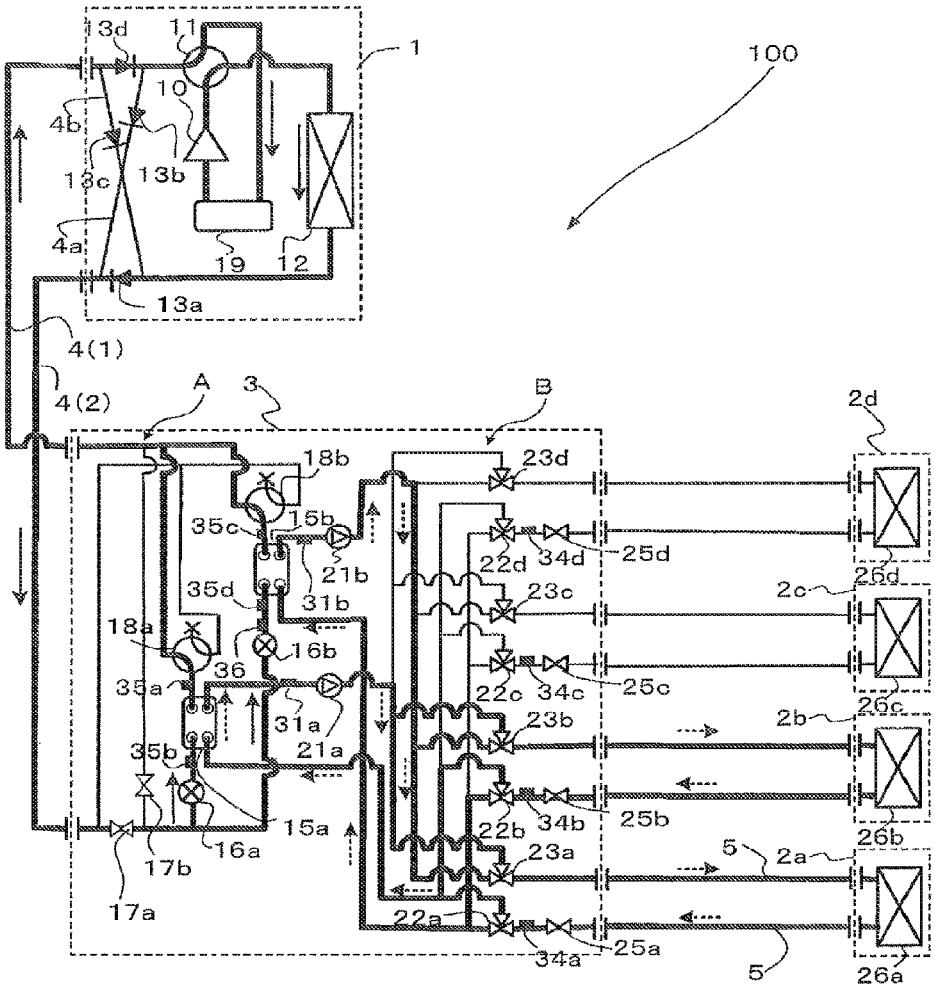
FIG. 4 is a refrigerant circuit diagram illustrating flows of refrigerants in a cooling only operation mode of the air-conditioning apparatus according to the Embodiment of the invention.

FIG. 4 is a refrigerant circuit diagram illustrating the flow of the refrigerant in the cooling only operation mode of the air-conditioning apparatus 100. The cooling only operation mode will be described with respect to a case in which a cooling load occurs only in the use side heat exchanger 26*a* and the use side heat exchanger 26*b* in FIG. 4. Furthermore, in FIG. 4, pipes indicated by thick lines correspond to pipes through which the refrigerants (the heat-source-side refrigerant and the heat medium) flow. Furthermore, the direction of flow of the heat-source-side refrigerant is indicated by solid-line arrows and the direction of flow of the heat medium is indicated by broken-line arrows in FIG. 4.

In the cooling only operation mode illustrated in FIG. 4, the first refrigerant flow switching device 11 in the outdoor unit 1 is switched so that the heat-source-side refrigerant discharged from the compressor 10 flows into the heat source side heat exchanger 12. In the relay unit 3, the pump 21*a* and the pump 21*b* are run, the heat medium flow rate control device 25*a* and the heat medium flow rate control device 25*b* are opened, and the heat medium flow rate control device 25*c* and the heat medium flow rate control device 25*c* are closed such that the heat medium circulates between each of the heat medium heat exchanger 15*a* and the heat medium heat exchanger 15*b* and each of the use side heat exchanger 26*a* and the use side heat exchanger 26*b*.

First, the flow of the heat-source-side refrigerant in the refrigerant circuit A will be first described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11 and flows into the heat source side heat exchanger 12. Then, the refrigerant condenses and liquefies into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant pipe 4, and flows into the relay unit 3. The high-pressure liquid refrigerant flowing into the relay unit 3 is branched after passing through the opening and closing device 17*a* and is then expanded into a low-temperature low-pressure two-phase refrigerant by the expansion device 16*a* and expansion device 16*b*.

This two-phase refrigerant flows into each of the heat exchanger related to heat medium 15*a* and the heat exchanger related to heat medium 15*b*, functioning as evaporators, takes heat away from the heat medium circulating in the heat medium circuit B to cool the heat medium, and turns into a low-temperature low-pressure gas refrigerant. The gas refrigerant, which has flowed out of each of the heat exchanger related to heat medium 15*a* and the heat exchanger related to heat medium 15*b*, flows out of the relay unit 3 through the second refrigerant flow switching device 18*a* and the second refrigerant flow switching device 18*b*, passes through the refrigerant pipe 4, and again flows into the outdoor unit 1. The refrigerant flowing into the outdoor unit 1 passes through the check valve 13*d*, and is again sucked into the compressor 10 via the first refrigerant flow switching device 11 and the accumulator 19.

At this time, the opening-degree of the expansion device 16*a* is controlled such that superheat (the degree of superheat), which is determined by the difference between a temperature detected by the third temperature sensor 35*a* and by the third temperature sensor 35*b*, is constant. Similarly, the opening-degree of the expansion device 16*b* is controlled such that superheat, which is determined by the difference between a temperature detected by the third temperature sensor 35*c* and by the third temperature sensor 35*d*, is constant. Furthermore, the opening and closing device 17*a* is opened and the opening and closing device 17*b* is closed.

Next, the flow of the heat medium in the heat medium circuit B will be described.

In the cooling only operation mode, both of the heat exchanger related to heat medium 15*a* and heat exchanger related to heat medium 15*b* transfer cooling energy of the heat-source-side refrigerant to the heat medium, and the cooled heat medium is made to flow in the pipes 5 by the pump 21*a* and pump 21*b*. The heat medium, which has flowed out of the pump 21*a* and the pump 21*b* while being pressurized, flows through into the use side heat exchanger 26*a* and the use side heat exchanger 26*b* via the second heat medium flow switching device 23*a* and the second heat medium flow switching device 23*b*. The heat medium takes heat away from the indoor air in each of the use side heat exchanger 26*a* and the use side heat exchanger 26*b*, thus cooling the indoor space 7.

The heat medium then flows out of each of the use side heat exchanger 26*a* and the use side heat exchanger 26*b* and flows into the heat medium flow rate control device 25*a* and the heat medium flow rate control device 25*b*. At this time, with the effect of the heat medium flow rate control device 25*a* and the heat medium flow rate control device 25*b*, the flow rates of the heat medium flowing into the use side heat exchanger 26*a* and the use side heat exchanger 26*b* are controlled to flow rates necessary to cover an air-conditioning load required in the indoor space. The heat medium, which has flowed out of the heat medium flow rate control device 25*a* and the heat medium flow rate control device 25*b*, passes through the corresponding first heat medium flow switching device 22*a* and the first heat medium flow switching device 22*b*, flows into the heat exchanger related to heat medium 15*a* and the heat exchanger related to heat medium 15*b*, and is then again sucked into the corresponding pump 21*a* and pump 21*b*.

Note that in the pipes 5 in each use side heat exchanger 26, the heat medium flows in a direction from the second heat medium flow switching device 23 through the heat medium flow rate control device 25 to the first heat medium flow switching device 22. Furthermore, the air-conditioning load required in the indoor space 7 can be covered by controlling the difference between a temperature detected by the first temperature sensor 31*a* or that detected by the first temperature sensor 31*b* and a temperature detected by the second temperature sensor 34 to be kept to a target value. As regards a temperature at the outlet of each heat exchanger related to heat medium 15, either of the temperature detected by the first temperature sensor 31*a* and that by the first temperature sensor 31*b* may be used or the mean temperature of them may be used. At this time, the opening-degree of each of the first heat medium flow switching devices 22 and the second heat medium flow switching devices 23 is set to a medium degree such that flow paths to both of the heat exchanger related to heat medium 15*a* and the heat exchanger related to heat medium 15*b* are maintained.

Upon carrying out the cooling only operation mode, since it is unnecessary to supply the heat medium to a use side heat exchanger 26 having no air-conditioning load (including thermo-off), the flow path is closed by the corresponding heat medium flow rate control device 25 such that the heat medium does not flow into the use side heat exchanger 26. In FIG. 4, the heat medium flows into the use side heat exchanger 26*a* and the use side heat exchanger 26*b* because these use side heat exchangers have an air-conditioning load. On the other hand, the use side heat exchanger 26*c* and the use side heat exchanger 26*d* have no air-conditioning load and the corresponding heat medium flow rate control devices 25*c* and 25*d* are fully closed. When a heating load occurs in the use side heat exchanger 26*c* or the use side heat exchanger 26*d*, the heat medium flow rate control device 25*c* or the heat medium flow rate control device 25*d* may be opened such that the heat medium is circulated.

[Heating Only Operation Mode]

Figure 5:
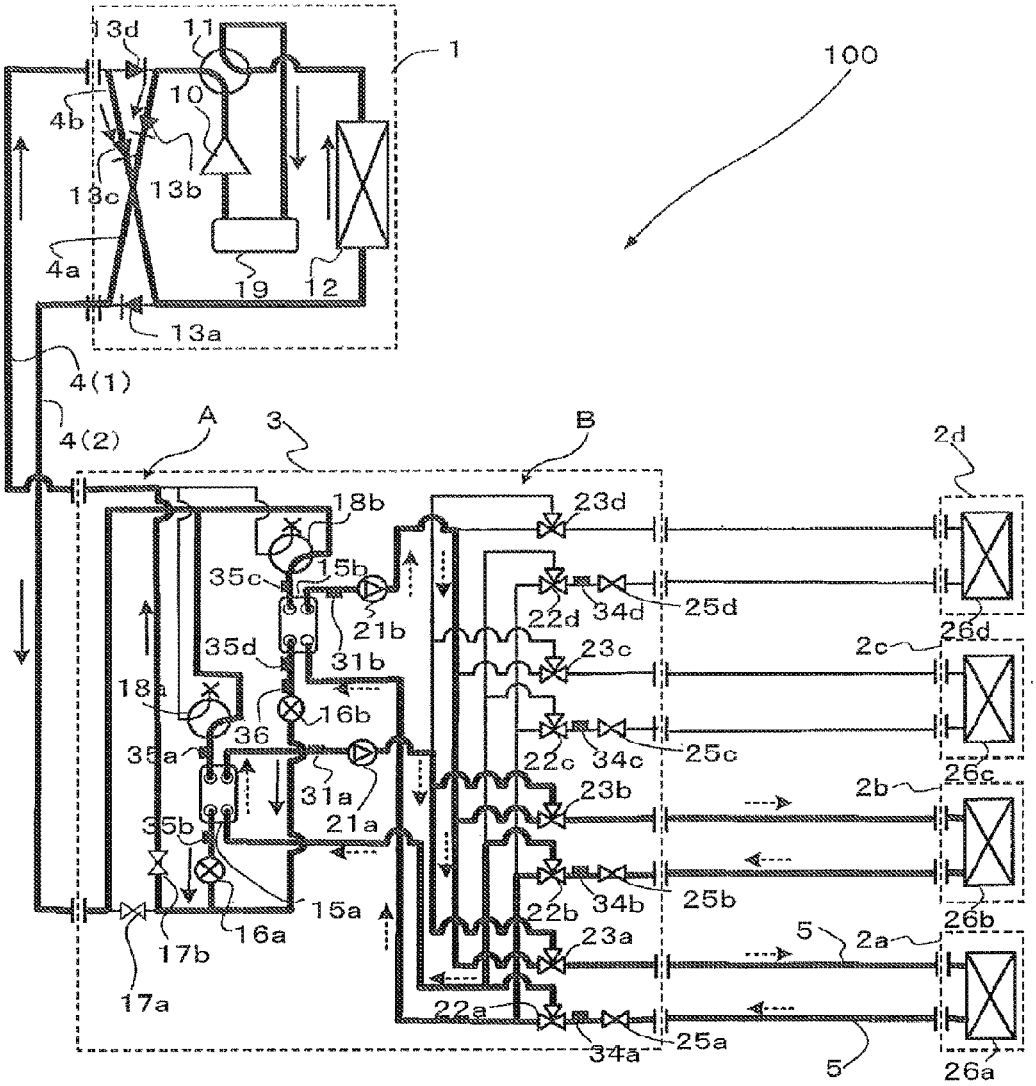
FIG. 5 is a refrigerant circuit diagram illustrating flows of the refrigerants in a heating only operation mode of the air-conditioning apparatus according to the Embodiment of the invention.

FIG. 5 is a refrigerant circuit diagram illustrating the flows of the refrigerants in the heating only operation mode in the air-conditioning apparatus 100. The heating only operation mode will be described with respect to a case in which a heating load occurs only in the use side heat exchanger 26*a* and the use side heat exchanger 26*b* in FIG. 5. Furthermore, in FIG. 5, pipes indicated by thick lines correspond to pipes through which the refrigerants (the heat-source-side refrigerant and the heat medium) flow. Furthermore, the direction of flow of the heat-source-side refrigerant is indicated by solid-line arrows and the direction of flow of the heat medium is indicated by broken-line arrows in FIG. 5.

In the heating only operation mode illustrated in FIG. 5, the first refrigerant flow switching device 11 in the outdoor unit 1 is switched so that the heat-source-side refrigerant discharged from the compressor 10 flows into the relay unit without passing through the heat source side heat exchanger 12. In the relay unit 3, the pump 21*a* and the pump 21*b* are run, the heat medium flow rate control device 25*a* and the heat medium flow rate control device 25*b* are opened, and the heat medium flow rate control device 25*c* and the heat medium flow rate control device 25*c* are closed such that the heat medium circulates between each of the heat medium heat exchanger 15*a* and the heat medium heat exchanger 15*b* and each of the use side heat exchanger 26*a* and the use side heat exchanger 26*b*.

First, the flow of the heat-source-side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant, which has flowed out of the outdoor unit 1, passes through the refrigerant pipe 4 and flows into the relay unit 3. The high-temperature high-pressure gas refrigerant flowing into the relay unit 3 is branched. The refrigerant passes through each of the second refrigerant flow switching device 18*a* and the second refrigerant flow switching device 18*b* and flows into the corresponding heat exchanger related to heat medium 15*a* and heat exchanger related to heat medium 15*b*.

The high-temperature high-pressure gas refrigerant flowing into each of the heat exchanger related to heat medium 15*a* and the heat exchanger related to heat medium 15*b* condenses and liquefies into a high-pressure liquid refrigerant while transferring heat to the heat medium circulating in the heat medium circuit B. The liquid refrigerant, which has flowed out of the heat exchanger related to heat medium 15*a* and the heat exchanger related to heat medium 15*b*, is expanded into a low-temperature low-pressure two-phase refrigerant by the corresponding expansion device 16*a* and the expansion device 16*b*. This two-phase refrigerant passes through the opening and closing device 17*b*, flows out of the relay unit 3, and again flows into the outdoor unit 1 through the refrigerant pipe 4. The refrigerant flowing into the outdoor unit 1 flows through the second connecting pipe 4*b*, passes through the check valve 13*c*, and flows into the heat source side heat exchanger 12, functioning as an evaporator.

The refrigerant flowing into the heat source side heat exchanger 12 then takes heat away from the outdoor air in the heat source side heat exchanger 12 and turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening-degree of the expansion device 16*a* is controlled such that subcool (the degree of subcooling), which is determined by the difference between a saturation temperature converted from a pressure detected by the pressure sensor 36 and a temperature detected by the third temperature sensor 35*b*, is constant. Similarly, the opening-degree of the expansion device 16*b* is controlled such that subcool, which is determined by the difference between the value indicating the saturation temperature converted from the pressure detected by the pressure sensor 36 and a temperature detected by the third temperature sensor 35*d*, is constant. Furthermore, the opening and closing device 17*a* is closed and the opening and closing device 17*b* is opened. Also, in the case in which a temperature in the middle of the heat exchangers related to heat medium 15 can be measured, the temperature in the middle may be used instead of the pressure sensor 36. Thus, an inexpensive system can be constructed.

Next, the flow of the heat medium in the heat medium circuit B will be described.

In the warming only operation mode, both of the heat exchanger related to heat medium 15*a* and heat exchanger related to heat medium 15*b* transfer heating energy of the heat-source-side refrigerant to the heat medium, and the heated heat medium is made to flow in the pipes 5 by the pump 21*a* and pump 21*b*. The heat medium, which has flowed out of the pump 21*a* and the pump 21*b* while being pressurized, flows through into the use side heat exchanger 26*a* and the use side heat exchanger 26*b* via the second heat medium flow switching device 23*a* and the second heat medium flow switching device 23*b*. The heat medium transfers heat from the indoor air in each of the use side heat exchanger 26*a* and the use side heat exchanger 26*b*, thus heating the indoor space 7.

The heat medium then flows out of each of the use side heat exchanger 26*a* and the use side heat exchanger 26*b* and flows into the heat medium flow rate control device 25*a* and the heat medium flow rate control device 25*b*. At this time, with the effect of the heat medium flow rate control device 25*a* and the heat medium flow rate control device 25*b*, the flow rate of the heat medium flowing into the use side heat exchanger 26*a* and the use side heat exchanger 26*b* is controlled to a flow rate necessary to cover an air-conditioning load required in the indoor space. The heat medium, which has flowed out of the heat medium flow rate control device 25*a* and the heat medium flow rate control device 25*b*, passes through the corresponding first heat medium flow switching device 22*a* and the first heat medium flow switching device 22*b*, flows into the heat exchanger related to heat medium 15*a* and the heat exchanger related to heat medium 15*b*, and is then again sucked into the corresponding pump 21*a* and pump 21*b*.

Note that in the pipes 5 in each use side heat exchanger 26, the heat medium flows in a direction from the second heat medium flow switching device 23 through the heat medium flow rate control device 25 to the first heat medium flow switching device 22. Furthermore, the air-conditioning load required in the indoor space 7 can be covered by controlling the difference between a temperature detected by the first temperature sensor 31*a* or that detected by the first temperature sensor 31*b* and a temperature detected by the second temperature sensor 34 to be kept to a target value. As regards a temperature at the outlet of each heat exchanger related to heat medium 15, either of the temperature detected by the first temperature sensor 31*a* and that by the first temperature sensor 31*b* may be used or the mean temperature of them may be used.

At this time, the opening-degree of each of the first heat medium flow switching devices 22 and the second heat medium flow switching devices 23 is set to a medium degree such that flow paths to both of the heat exchanger related to heat medium 15*a* and the heat exchanger related to heat medium 15*b* are maintained. Although each use side heat exchanger 26 should essentially be controlled on the basis of the difference between a temperature at the inlet and that at the outlet, since the temperature of the heat medium on the inlet side of the use side heat exchanger 26 is substantially the same as that detected by the first temperature sensor 31*b*, the use of the first temperature sensor 31*b* can reduce the number of temperature sensors, and thus an inexpensive system can be constructed.

Upon carrying out the heating only operation mode, since it is unnecessary to supply the heat medium to a use side heat exchanger 26 having no air-conditioning load (including thermo-off), the flow path is closed by the corresponding heat medium flow rate control device 25 such that the heat medium does not flow into the use side heat exchanger 26. In FIG. 5, the heat medium flows into the use side heat exchanger 26*a* and the use side heat exchanger 26*b* because these use side heat exchangers have an air-conditioning load. On the other hand, the use side heat exchanger 26*c* and the use side heat exchanger 26*d* have no air-conditioning load and the corresponding heat medium flow rate control devices 25*c* and 25*d* are fully closed. When a heating load occurs in the use side heat exchanger 26*c* or the use side heat exchanger 26*d*, the heat medium flow rate control device 25*c* or the heat medium flow rate control device 25*d* may be opened such that the heat medium is circulated.

[Cooling-Main Operation Mode]

Figure 6:
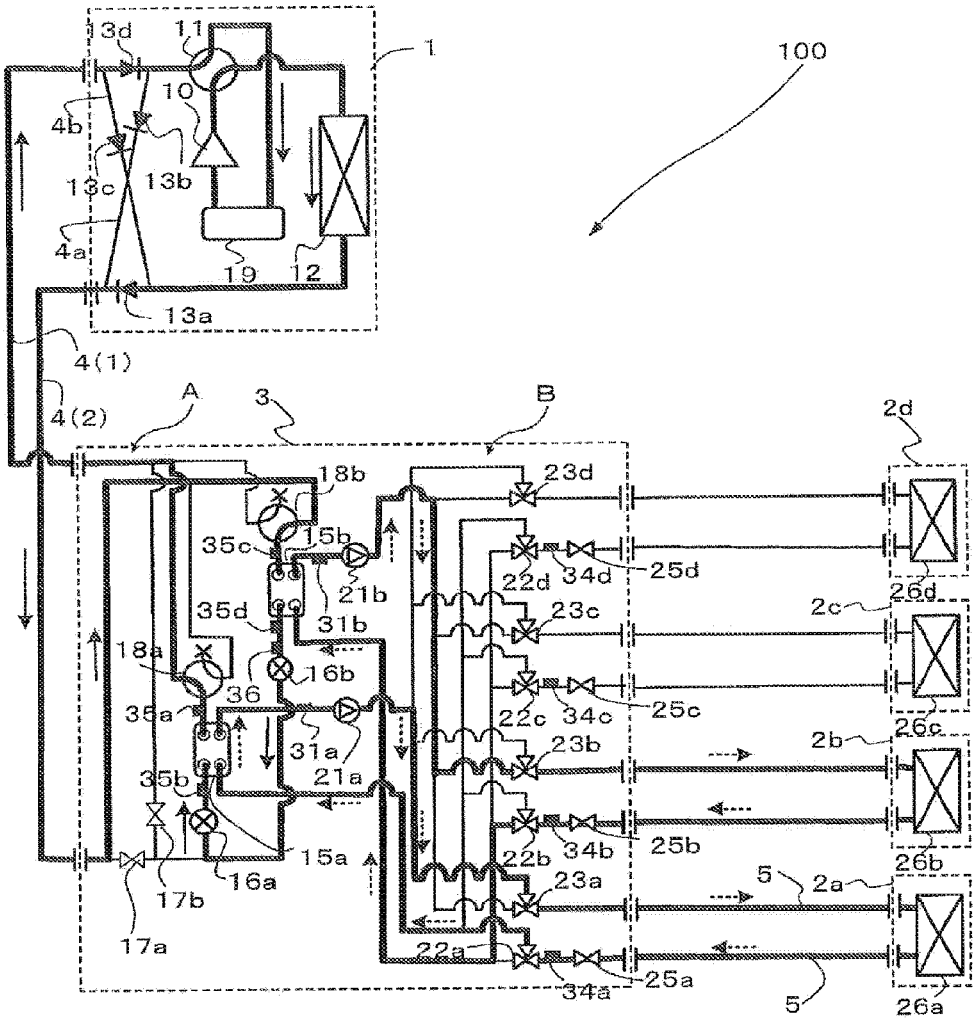
FIG. 6 is a refrigerant circuit diagram illustrating flows of the refrigerants in a cooling-main operation mode of the air-conditioning apparatus according to the Embodiment of the invention.

FIG. 6 is a refrigerant circuit diagram illustrating the flows of the refrigerants in the cooling-main operation mode of the air-conditioning apparatus 100. The cooling-main operation mode will be described with respect to a case in which a cooling load occurs in the use side heat exchanger 26*a* and a heating load occurs in the use side heat exchanger 26*b* in FIG. 6. Furthermore, in FIG. 6, pipes indicated by thick lines correspond to pipes through which the refrigerants (the heat-source-side refrigerant and the heat medium) circulate. Furthermore, the direction of flow of the heat-source-side refrigerant is indicated by solid-line arrows and the direction of flow of the heat medium is indicated by broken-line arrows in FIG. 6.

In the cooling-main operation mode illustrated in FIG. 6 the first refrigerant flow switching device 11 in the outdoor unit 1 is switched so that the heat-source-side refrigerant discharged from the compressor 10 flows into the heat source side heat exchanger 12. In the relay unit 3, the pump 21*a* and the pump 21*b* are run, the heat medium flow rate control device 25*a* and the heat medium flow rate control device 25*b* are opened, and the heat medium flow rate control device 25*c* and the heat medium flow rate control device 25*d* are closed such that the heat medium circulates between the heat exchanger related to heat medium 15*a* and the use side heat exchanger 26*a* and the heat medium circulates between the heat exchanger related to heat medium 15*b* and the use side heat exchanger 26*b*.

First, the flow of the heat-source-side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11 and flows into the heat source side heat exchanger 12. Then, the refrigerant condenses into a two-phase refrigerant while transferring heat to outdoor air in the heat source side heat exchanger 12. The two-phase refrigerant flowing out of the heat source side heat exchanger 12 passes through the check valve 13*a*, flows out of the outdoor unit 1, passes through the refrigerant pipe 4, and flows into the relay unit 3. The two-phase refrigerant flowing into the relay unit 3 passes through the second refrigerant flow switching device 18*b* and flows into the heat exchanger related to heat medium 15*b*, functioning as a condenser.

The two-phase refrigerant flowing into the heat exchanger related to heat medium 15*b* condenses and liquefies into a liquid refrigerant while transferring heat to the heat medium circulating in the heat medium circuit B. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* takes heat away from the heat medium circulating in the heat medium circuit B to cool the heat medium, and turns into a low-pressure gas refrigerant. This gas refrigerant flows out of the heat exchanger related to heat medium 15*a*, flows through the second refrigerant flow switching device 18*a* out of the relay unit 3, passes through the refrigerant pipe 4, and again flows into the outdoor unit 1. The refrigerant flowing into the outdoor unit 1 passes through the check valve 13*d* and is again sucked into the compressor 10 via the first refrigerant flow switching device 11 and the accumulator 19.

At this time, the opening-degree of the expansion device 16*b* is controlled such that superheat, which is determined by the difference between a temperature detected by the third temperature sensor 35*a* and by the third temperature sensor 35*b*, is constant. Furthermore, the expansion device 16*a* is fully opened, the opening and closing device 17*a* is closed, and the opening and closing device 17*b* is closed. Also, the opening-degree of the expansion device 16*b* may be controlled such that subcool, which is determined by the difference between a saturation temperature converted from a pressure detected by the pressure sensor 36 and a temperature detected by the third temperature sensor 35*d*, is constant. Alternatively, the expansion device 16*b* may be fully opened and the expansion device 16*a* may control superheat or subcool.

Next, the flow of the heat medium in the heat medium circuit B will be described.

In the cooling-main operation mode, the heat exchanger related to heat medium 15*b* transfers heating energy of the heat-source-side refrigerant to the heat medium, and the heated heat medium is made to flow in the pipes 5 by the pump 21*b*. Furthermore, in the cooling-main operation mode, the heat exchanger related to heat medium 15*a* transfers cooling energy of the heat-source-side refrigerant to the heat medium, and the cooled heat medium is made to flow in the pipes 5 by the pump 21. The heat medium, which has flowed out of the pump 21*a* and the pump 21*b* while being pressurized, passes through the corresponding second heat medium flow switching device 23*a* and second heat medium flow switching device 23*b* and then flows into the corresponding use side heat exchanger 26*a* and use side heat exchanger 26*b*.

In the use side heat exchanger 26*b*, the heat medium transfers heat to the indoor air, thus heats the indoor space 7. Furthermore, in the use side heat exchanger 26*a*, the heat medium takes heat away from the indoor air, thus cools the indoor space 7. At this time, with the effect of the heat medium flow rate control device 25*a* and the heat medium flow rate control device 25*b*, the flow rates of the heat medium flowing into the use side heat exchanger 26*a* and the use side heat exchanger 26*b* are controlled to flow rates necessary to cover an air-conditioning load required in the indoor space. The heat medium, which has passed through the use side heat exchanger 26*b* with a slight decrease of temperature, passes through the heat medium flow rate control device 25*b* and the first heat medium flow switching device 22*b*, flows into the heat exchanger related to heat medium 15*b*, and is then again sucked into the pump 21*b*. The heat medium, which has passed through the use side heat exchanger 26*a* with a slight increase of temperature, passes through the heat medium flow rate control device 25*a* and the first heat medium flow switching device 22*a*, flows into the heat exchanger related to heat medium 15*a*, and is then again sucked into the pump 21*a*.

During this time, by the function of the first heat medium flow switching devices 22 and the second heat medium flow switching devices 23, the hot heat medium and the cold heat medium is introduced into the use side heat exchanger 26 having a heating load and the use side heat exchanger 26 having a cooling load, respectively, without being mixed. Note that in the pipes 5 in each of the use side heat exchanger 26 for heating and that for cooling, the heat medium flows in a direction in which it flows from the second heat medium flow switching device 23 through the heat medium flow rate control device 25 to the first heat medium flow switching device 22. Furthermore, the air-conditioning load required in the indoor space 7 to be heated can be covered by controlling the difference between a temperature detected by the first temperature sensor 31*b* and that by the second temperature sensor 34 to be kept to a target value and the air-conditioning load required in the indoor space 7 to be cooled can be covered by controlling the difference between a temperature detected by the second temperature sensor 34 and that by the first temperature sensor 31*a* to be kept to a target value.

Upon carrying out the cooling-main operation mode, since it is unnecessary to supply the heat medium to a use side heat exchanger 26 having no air-conditioning load (including thermo-off), the flow path is closed by the corresponding heat medium flow rate control device 25 such that the heat medium does not flow into the use side heat exchanger 26. In FIG. 6, the heat medium flows into the use side heat exchanger 26*a* and the use side heat exchanger 26*b* because these use side heat exchangers have an air-conditioning load. On the other hand, the use side heat exchanger 26*c* and the use side heat exchanger 26*d* have no air-conditioning load and the corresponding heat medium flow rate control devices 25*c* and 25*d* are fully closed. When a heating load occurs in the use side heat exchanger 26*c* or the use side heat exchanger 26*d*, the heat medium flow rate control device 25*c* or the heat medium flow rate control device 25*d* may be opened such that the heat medium is circulated.

[Heating-Main Operation Mode]

Figure 7:
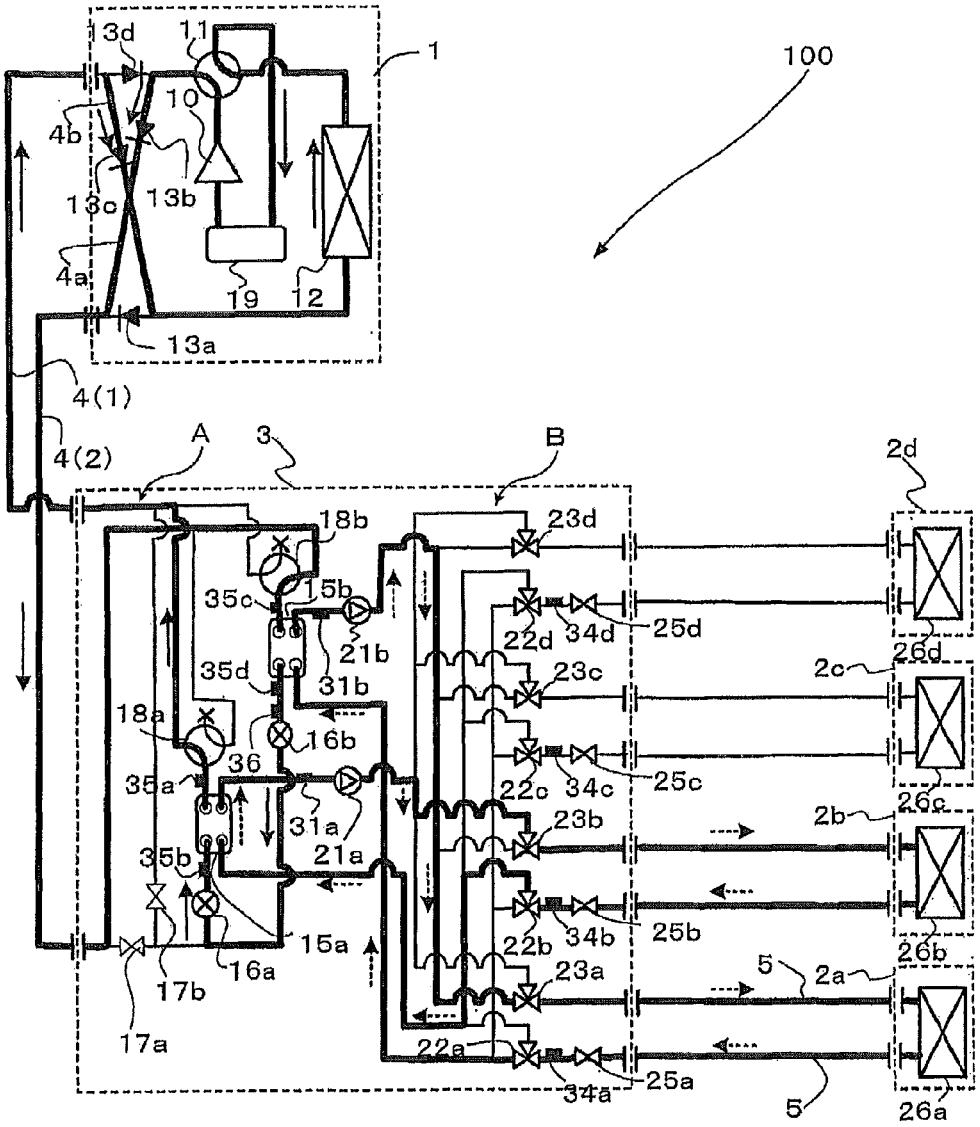
FIG. 7 is a refrigerant circuit diagram illustrating flows of the refrigerants in a heating-main operation mode of the air-conditioning apparatus according to the Embodiment of the invention.

FIG. 7 is a refrigerant circuit diagram illustrating the flows of the refrigerants in the heating-main operation mode of the air-conditioning apparatus 100. The heating-main operation mode will be described with respect to a case in which a heating load occurs in the use side heat exchanger 26*a* and a cooling load occurs in the use side heat exchanger 26*b* in FIG. 7. Furthermore, in FIG. 7, pipes indicated by thick lines correspond to pipes through which the refrigerants (the heat-source-side refrigerant and the heat medium) circulate. Furthermore, the direction of flow of the heat-source-side refrigerant is indicated by solid-line arrows and the direction of flow of the heat medium is indicated by broken-line arrows in FIG. 7.

In the heating-main operation mode illustrated in FIG. 7, the first refrigerant flow switching device 11 in the outdoor unit 1 is switched so that the heat-source-side refrigerant discharged from the compressor 10 flows into the relay unit without passing through the heat source side heat exchanger 12. In the relay unit 3, the pump 21*a* and the pump 21*b* are run, the heat medium flow rate control device 25*a* and the heat medium flow rate control device 25*b* are opened, and the heat medium flow rate control device 25*c* and the heat medium flow rate control device 25*d* are closed such that the heat medium circulates between the heat medium heat exchanger 15*b* and the use side heat exchanger 26*a* and the heat medium circulates between the heat medium heat exchanger 15*a* and the use side heat exchanger 26*b*.

First, the flow of the heat-source-side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant, which has flowed out of the outdoor unit 1, passes through the refrigerant pipe 4 and flows into the relay unit 3. The high-temperature high-pressure gas refrigerant flowing into the relay unit 3 passes through the second refrigerant flow switching device 18*b* and flows into the heat exchanger related to heat medium 15*b*, functioning as a condenser.

The gas refrigerant flowing into the heat exchanger related to heat medium 15*b* condenses and liquefies into a liquid refrigerant while transferring heat to the heat medium circulating in the heat medium circuit B. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* takes heat away from the heat medium circulating in the heat medium circuit B to evaporate, cooling the heat medium. This low-pressure two-phase refrigerant flows out of the heat exchanger related to heat medium 15*a*, flows out of the relay unit 3 via the second refrigerant flow switching device 18*a*, passes through the refrigerant pipe 4, and again flows into the outdoor unit 1.

The refrigerant flowing into the outdoor unit 1 passes through the check valve 13*c* and flows into the heat source side heat exchanger 12, functioning as an evaporator. The refrigerant flowing into the heat source side heat exchanger 12 takes heat away from the outdoor air in the heat source side heat exchanger 12 and turns into a low-temperature low-pressure gas refrigerant. The low-temperature low-pressure gas refrigerant flowing out of the heat source side heat exchanger 12 is again sucked into the compressor 10 via the first refrigerant flow switching device 11 and the accumulator 19.

At this time, the opening-degree of the expansion device 16*b* is controlled such that subcool, which is determined by the difference between a saturation temperature converted from a pressure detected by the pressure sensor 36 and a temperature detected by the third temperature sensor 35*b*, is constant. Furthermore, the expansion device 16*a* is fully opened, the opening and closing device 17*a* is closed, and the opening and closing device 17*b* is closed. Alternatively, the expansion device 16*b* may be fully opened and the expansion device 16*a* may control subcool.

Next, the flow of the heat medium in the heat medium circuit B will be described.

In the heating-main operation mode, the heat exchanger related to heat medium 15*b* transfers heating energy of the heat-source-side refrigerant to the heat medium, and the heated heat medium is made to flow in the pipes 5 by the pump 21*b*. Furthermore, in the heating-main operation mode, the heat exchanger related to heat medium 15*a* transfers cooling energy of the heat-source-side refrigerant to the heat medium, and the cooled heat medium is made to flow in the pipes 5 by the pump 21. The heat medium, which has flowed out of the pump 21*a* and the pump 21*b* while being pressurized, passes through the corresponding second heat medium flow switching device 23*a* and second heat medium flow switching device 23*b* and then flows into the corresponding use side heat exchanger 26*a* and use side heat exchanger 26*b*.

In the use side heat exchanger 26*b*, the heat medium takes heat away from the indoor air, thus cools the indoor space 7. Furthermore, in the use side heat exchanger 26*a*, the heat medium transfers heat to the indoor air, thus heats the indoor space 7. At this time, with the effect of the heat medium flow rate control device 25*a* and the heat medium flow rate control device 25*b*, the flow rates of the heat medium flowing into the use side heat exchanger 26*a* and the use side heat exchanger 26*b* are controlled to flow rates necessary to cover an air-conditioning load required in the indoor space. The heat medium, which has passed through the use side heat exchanger 26*b* with a slight increase of temperature, passes through the heat medium flow rate control device 25*b* and the first heat medium flow switching device 22*b*, flows into the heat exchanger related to heat medium 15*b*, and is then again sucked into the pump 21*b*. The heat medium, which has passed through the use side heat exchanger 26*a* with a slight decrease of temperature, passes through the heat medium flow rate control device 25*a* and the first heat medium flow switching device 22*a*, flows into the heat exchanger related to heat medium 15*a*, and is then again sucked into the pump 21*a*.

During this time, by the function of the first heat medium flow switching devices 22 and the second heat medium flow switching devices 23, the hot heat medium and the cold heat medium is introduced into the use side heat exchanger 26 having a heating load and the use side heat exchanger 26 having a cooling load, respectively, without being mixed. Note that in the pipes 5 in each of the use side heat exchanger 26 for heating and that for cooling, the heat medium flows in a direction in which it flows from the second heat medium flow switching device 23 through the heat medium flow rate control device 25 to the first heat medium flow switching device 22. Furthermore, the air-conditioning load required in the indoor space 7 to be heated can be covered by controlling the difference between a temperature detected by the first temperature sensor 31*b* and that by the second temperature sensor 34 to be kept to a target value and the air-conditioning load required in the indoor space 7 to be cooled can be covered by controlling the difference between a temperature detected by the second temperature sensor 34 and that by the first temperature sensor 31*a* to be kept to a target value.

Upon carrying out the heating-main operation mode, since it is unnecessary to supply the heat medium to a use side heat exchanger 26 having no air-conditioning load (including thermo-off), the flow path is closed by the corresponding heat medium flow rate control device 25 such that the heat medium does not flow into the use side heat exchanger 26. In FIG. 7, the heat medium flows into the use side heat exchanger 26*a* and the use side heat exchanger 26*b* because these use side heat exchangers have an air-conditioning load. On the other hand, the use side heat exchanger 26*c* and the use side heat exchanger 26*d* have no air-conditioning load and the corresponding heat medium flow rate control devices 25*c* and 25*d* are fully closed. When a heating load occurs in the use side heat exchanger 26*c* or the use side heat exchanger 26*d*, the heat medium flow rate control device 25*c* or the heat medium flow rate control device 25*d* may be opened such that the heat medium is circulated.

[Refrigerant Pipes 4]

As described above, the air-conditioning apparatus 100 according to the Embodiment has the several operation modes. In these operation modes, the heat-source-side refrigerant flows through the pipes 4 connecting the outdoor unit 1 and the relay unit 3. The refrigerant pipes 4 used in the air-conditioning apparatus 100 according to the Embodiment will now be described in detail.

Narrower refrigerant pipes (having a smaller inner diameter) are more appreciated. The reason for it is that such a refrigerant pipe is inexpensive, is easier to bend with ease of construction, and is small in heat loss since it has small surface area. However, if the refrigerant pipe becomes narrow, pressure loss of the heat-source-side refrigerant increases. Typically, therefore, pressure loss is first considered in order to select the narrowest refrigerant pipes possible.

In the refrigeration cycle, according to the law of mass conservation, the value of mass flow rate of the heat-source-side refrigerant is the same anywhere in the refrigerant pipes. The relationship among the mass flow rate, the flow velocity, and the density is expressed by the following Equation (1).

$$\text{mass flow rate [kg/s]} = \text{flow-path cross-sectional area [m}^2\text{]} \times \text{flow velocity [m/s]} \times \text{density [kg/m}^3\text{]} \quad \text{Equation (1)}$$

When the flow velocity in Equation (1) is moved to the left side, the following Equation (2) is obtained.

$$\text{flow velocity [m/s]} = (\text{mass flow rate [kg/s]/flow-path cross-sectional area [m}^2\text{])/density [kg/m}^3\text{]} \quad \text{Equation (2)}$$

It is evident from Equation (2) that, assuming that the flow path has the same cross-sectional area, as the density becomes lower, the flow velocity in a refrigerant pipe increases, because the mass flow rate has the same value within a refrigeration cycle. Furthermore, it is evident from the Darcy-Weisbach equation (the following Equation (3)), which is a generally a well-known equation in fluid dynamics, that the pressure loss in the refrigerant pipe is the largest when the density of the refrigerant is the lowest, because pressure loss is proportional to the square of the flow velocity.

$$h = f \cdot (L/d) \cdot \{v^2/(2 \cdot g)\} \quad \text{Equation (3)}$$

In Equation (3), h denotes the friction loss [m] of the refrigerant pipe, f denotes the coefficient of friction, v denotes the mean flow velocity [m/s] in the refrigerant pipe, d denotes the inner diameter [m] in the refrigerant pipe, g denotes the acceleration of gravity [m/s$^2$], and L denotes the length of the refrigerant pipe.

With respect to refrigerants, the density of a gas refrigerant is lower than that of a liquid refrigerant and the density of a low-pressure gas refrigerant is lower than that of a high-pressure gas refrigerant. On the other hand, in the air-conditioning apparatus 100 according to the Embodiment, the high-pressure gas refrigerant in the heating operation and the heating-main operation, the high-pressure liquid refrigerant in the cooling operation, and the high-pressure two-phase refrigerant in the cooling-main operation pass through the same refrigerant pipe 4 (the refrigerant pipe 4(2) in the figures). The low-pressure two-phase refrigerant in the heating operation and the heating-main operation and the low-pressure gas refrigerant in the cooling operation and the cooling-main operation pass through the same refrigerant pipe (the refrigerant pipe 4(1) in the figures).

That is, with respect to the pressure loss in the refrigerant pipes 4, pressure loss increases in the refrigerant pipe 4(2) when the high-pressure gas refrigerant passes therethrough and in the refrigerant pipe 4(1) when the low-pressure gas refrigerant passes therethrough. It is therefore necessary to determine the inner diameter (inner cross-sectional area) of the refrigerant pipe 4 on the assumption of these refrigerant conditions.

Furthermore, the refrigerant pipes 4 are connected from, for example, a roof to an indoor space such as an attic, and the length becomes several tens of meters. If the amount of refrigerant in the entire system increases, excess refrigerant will increase while operating in a condition in which small amount of refrigerant is required, and the accumulator 19 will not be able to collect all the excessive refrigerant. It is when the liquid refrigerant flows in the refrigerant pipe 4(2) that the amount of refrigerant therein increases. By using the narrowest refrigerant pipe 4(2) possible allows a reduction in the amount of refrigerant and, as described above, construction will be easier.

Since the diameters of the pipes are determined considering the above-described circumstances, in the air-conditioning apparatus 100 according to the Embodiment, the refrigerant pipe 4(2), in which high-pressure refrigerant flows, is made to have a smaller inner diameter (inner cross-sectional area) than that of the refrigerant pipe 4(1), in which low-pressure refrigerant flows. For example, assuming that the air-conditioning apparatus 100 according to the Embodiment has a capacity of about 10 horsepower (a cooling capacity of 28 kW), a pipe having an inner diameter of about 17 mm (an inner cross-sectional area of about 277 mm$^2$) as the refrigerant pipe 4(2) and a pipe having an inner diameter of about 20 mm (an inner cross-sectional area of about 314 mm$^2$) as the refrigerant pipe 4(1) are preferably used.

[Pipes 5]

In the several operation modes carried out by the air-conditioning apparatus 100 according to the Embodiment, the heat medium, such as water or antifreeze, flows through the pipes 5 connecting the relay unit 3 and the indoor units 2. The pipes 5 used in the air-conditioning apparatus 100 according to the Embodiment will now be described in detail.

Description will be made based on the assumption that copper pipes are used for pipes 5 and water is used for the heat medium flowing through the pipes. High velocity flow of water through the copper pipe causes erosion (erosion by mechanical action) and corrosion (corrosion by chemical action) in which the wall of the copper pipe becomes thin and, as a result, a hole is created. To prevent this, the flow velocity of water flowing through the copper pipe typically is set with a flow velocity limit (critical velocity). This critical velocity is generally less than or equal to 1.5 m/s according to many cases. If the pipe diameter of the copper pipe is too large, however, losses due to heat transfer from the copper pipe to the outside increases. It is therefore preferable to use a copper pipe having the smallest diameter as possible.

Therefore, as for the pipes 5 that are used in the air-conditioning apparatus 100 according to the Embodiment, those with an inner diameter such that the heat medium flowing therethrough will have a velocity slightly less than 1.5 m/s may be used. The inner diameter of the pipe 5 will be calculated so that the flow velocity will be 1.5 m/s. The relationship between the capacity (quantity of heat) of the indoor unit 2, the density of the heat medium, specific heat, the flow rate, and the difference between a temperature at an inlet of the indoor unit 2 and that at an outlet thereof holds as expressed by the following Equation (4).

$$\text{heat quantity [kW]} = \text{density [kg/m}^3\text{]} \times \text{specific heat [kJ/kgK]} \times \text{flow rate [m}^3\text{/s]} \times \text{temperature difference [K]} \quad \text{Equation (4)}$$

Assuming that the density of water is 1000 [kg/m$^3$], the specific heat is 4.18 [J/kgK], and the temperature difference is 5 [K], a flow rate necessary to connect an indoor unit having, for example, a capacity of about 10 horsepower (a cooling capacity of 28 kW) is $13.4\times10^{-4}$ [m$^3$/s], namely, 80 [L/min]. The relationship among the flow rate, the inner cross-sectional area of the pipe 5, and the flow velocity of the heat medium holds as expressed by the following Equation (5).

$$\text{flow rate [m}^3\text{/s]} = \text{cross-sectional area [m}^2\text{]} \times \text{flow velocity [m/s]} \quad \text{Equation (5)}$$

That is, in order to allow the flow velocity to be less than or equal to 1.5 m/s at a flow rate of $13.4\times10^{-4}$ [m$^3$/s] (80 [L/min]), a pipe having an inner diameter greater than or equal to $3.37\times10^{-2}$ m, namely, 33.7 mm (an inner cross-sectional area of about 892 mm$^2$) based on Equation (5) has to be used. As the pipes 5 used in the air-conditioning apparatus 100 according to the Embodiment, therefore, pipes having an inner diameter of, for example, 34 to 38 mm (an inner cross-sectional area of about 908 to 1134 mm$^2$) are used.

When compared with the above-described refrigerant pipes 4, the pipes exhibit the same capacity but the inner cross-sectional area of the pipes 5 through which the heat medium flows is larger than those of the pipes 4 through which the heat-source-side refrigerant flows. That is, in order to ensure safety and exhibit necessary capacity, pipes having a larger inner cross-sectional area per unit capacity than the refrigerant pipes 4 through which the heat-source-side refrigerant flows have to be used as the pipes 5 through which the heat medium flows.

Furthermore, from another viewpoint, assuming that the pipes 5 through which the heat medium flows have an inner diameter of 34 mm (an inner cross-sectional area of 908 mm$^2$), the inner cross-sectional area is about 2.9 times greater than that of the refrigerant pipe 4 through which the heat-source-side refrigerant flows which has an inner diameter of 20 mm (an inner cross-sectional area of 314 mm$^2$) and is about 4 times greater than that of the refrigerant pipe 4 which has an inner diameter of 17 mm (an inner cross-sectional area of 227 mm$^2$). That is, pipes having an inner cross-sectional area per unit capacity that is two or more times greater than those of the refrigerant pipes 4 through which the refrigerant flows have to be used as the pipes 5 through which the heat medium flows. Since the pipes 5 are selected as described above, the air-conditioning apparatus 100 can retard corrosion of the pipes 5, thus contributing to long-term energy saving.

Moreover, in the case in which a plurality of indoor units 2 is connected, the capacity (heat quantity) of each unit is reduced by an increase in number. For example, assuming that four indoor units 2 having a capacity of 2.5 horsepower (a cooling capacity of 7 kW) are connected, the capacity of each indoor unit 2 is ¼ the capacity of 10 horsepower. Accordingly, the flow rate in each indoor unit 2 is also reduced to ¼, namely, $3.35\times10^{-4}$ [m$^3$/s], namely, 20 [L/min]. Since the flow rate of water in the pipes has to be less than or equal to 1.5 m/s, the inner cross-sectional area of each pipe 5 in the case in which the indoor units 2 of 2.5 horsepower are connected is ¼ that in the case in which the indoor units 2 of 10 horsepower are connected. The inner cross-sectional area of the pipe 5 per unit capacity is the same irrespective of the capacity of the indoor unit 2.

In the air-conditioning apparatus 100, in the case in which only the heating load or cooing load occurs in the use side heat exchangers 26, the corresponding first heat medium flow switching devices 22 and the corresponding second heat medium flow switching devices 23 are controlled so as to have a medium opening-degree, such that the heat medium flows into both of the heat exchanger related to heat medium 15*a* and the heat exchanger related to heat medium 15*b*. Consequently, since both of the heat exchanger related to heat medium 15*a* and the heat exchanger related to heat medium 15*b* can be used for the heating operation or the cooling operation, the area of heat transfer is increased. Thus, efficient heating operation or cooling operation can be performed.

Furthermore, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the flow path connected to the heat exchanger related to heat medium 15*b* for heating, and the first heat medium flow switching device 22 and the second heat medium flow switching device 23 corresponding to the use side heat exchanger 26 which performs the cooling operation are switched to the flow path connected to the heat exchanger related to heat medium 15*a* for cooling, so that the heating operation or cooling operation can be freely performed in each indoor unit 2.

Figure 10:
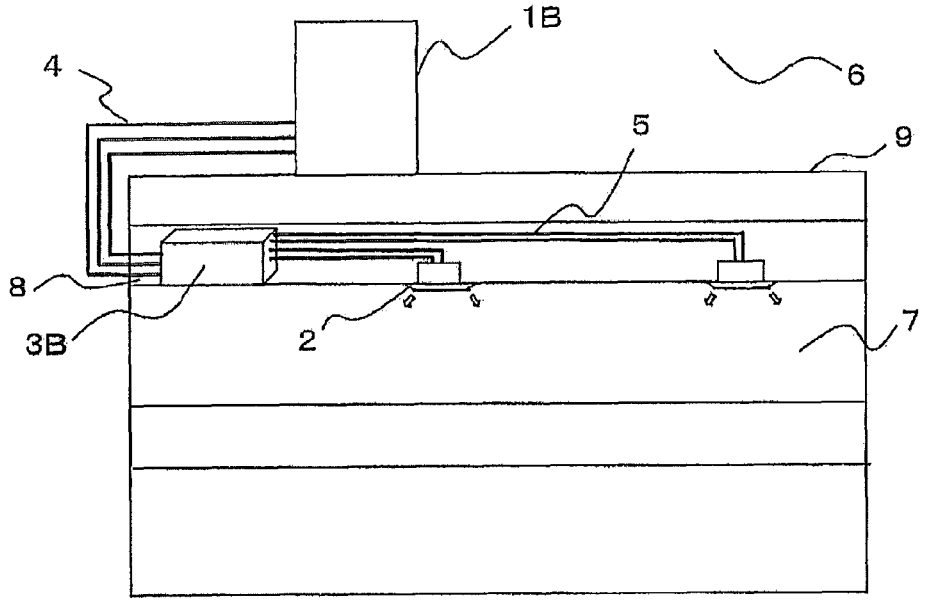
FIG. 10 is a schematic diagram illustrating an installation of the air-conditioning apparatus according to the Embodiment of the invention.
Figure 11:
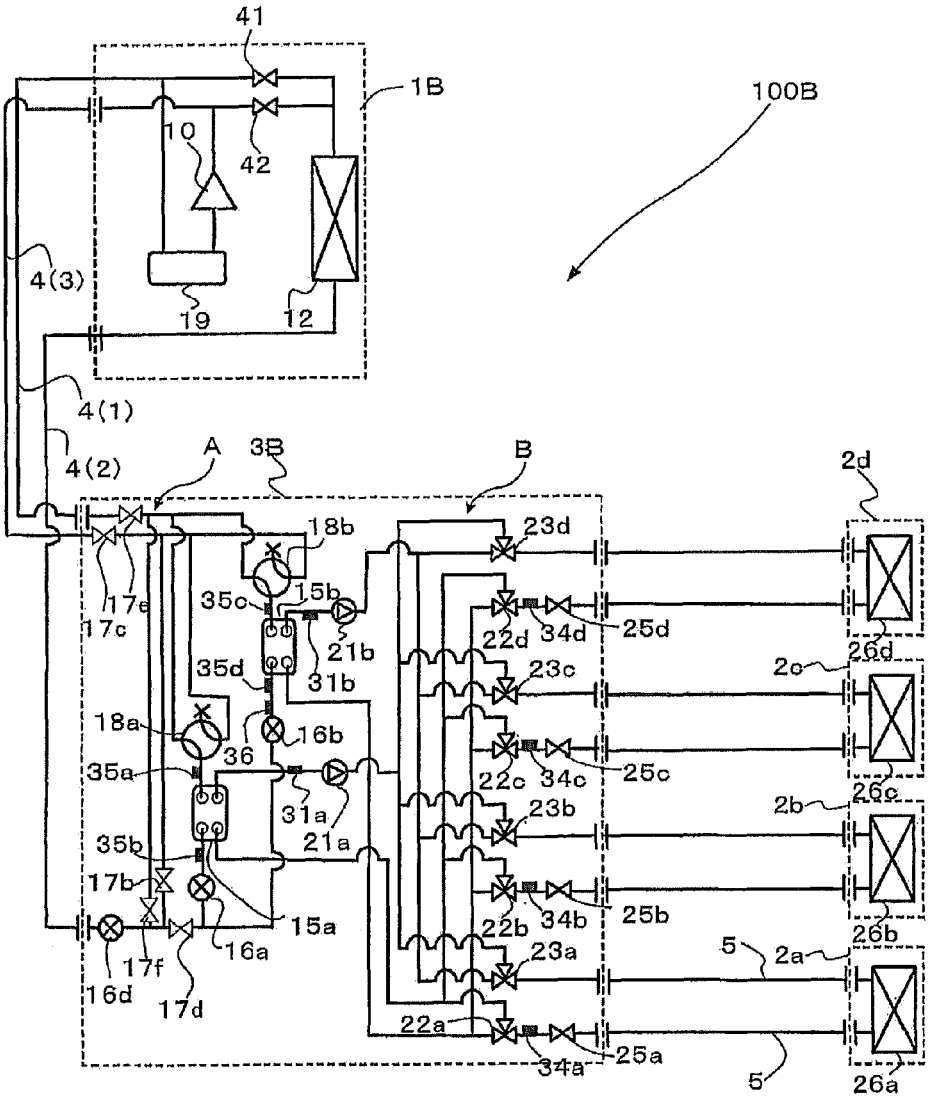
FIG. 11 is a schematic circuit diagram illustrating another configuration of the air-conditioning apparatus according to the Embodiment of the invention.

Furthermore, the air-conditioning apparatus according to the Embodiment may be an air-conditioning apparatus (hereinafter, referred to as an "air-conditioning apparatus 100B") including an outdoor unit (hereinafter, referred to as an "outdoor unit 1B") and a relay unit (hereinafter, referred to as a "relay unit 3B") connected through three refrigerant pipes 4 (a refrigerant pipe 4(1), a refrigerant pipe 4(2), a refrigerant pipe 4(3)) as illustrated in FIG. 11. Furthermore, FIG. 10 illustrates an installation of the air-conditioning apparatus 100B. That is, the air-conditioning apparatus 100B allows all of the indoor units 2 to perform the same operation and also allows the indoor units 2 to perform different operations. Furthermore, in the relay unit 3B, the refrigerant pipe 4(2) is provided with an expansion device 16*d* (such as an electronic expansion valve) merging the high-pressure liquid in the cooling-main operation mode.

The basic configuration of the air-conditioning apparatus 100B is the same as that of the air-conditioning apparatus 100 but the structure of the outdoor unit 1B and that of the relay unit 3B are slightly different from those in the air-conditioning apparatus 100. The outdoor unit 1B includes a compressor 10, a heat source side heat exchanger 12, an accumulator 19, and two flow switching units (flow switching unit 41 and flow switching unit 42). The relay unit 3B does not have the opening and closing device 17*a* and the refrigerant pipe which branches the refrigerant pipe 4(2) connecting to a second refrigerant flow switching device 18*b*. Instead, the relay unit 3B includes an opening and closing device 17*c* and an opening and closing device 17*d* and is configured such that a branch pipe provided with the opening and closing device 17*b* is connected to the refrigerant pipe 4(3). The relay unit 3B further includes a branch pipe connecting the refrigerant pipe 4(1) and the refrigerant pipe 4(2), an opening and closing device 17*e*, and an opening and closing device 17*f*.

The refrigerant pipe 4(3) connects a discharge pipe of the compressor 10 and the relay unit 3B. Each of the two flow switching units is constituted by, for example, a two-way valve and is configured to open and close the refrigerant pipes 4. The flow switching unit 41 is disposed between a suction pipe of the compressor 10 and the heat source side heat exchanger 12 and is configured to switch the flow directions of the heat-source-side refrigerant by control of the opening and closing. The flow switching unit 42 is disposed between the discharge pipe of the compressor 10 and the heat source side heat exchanger 12 and is configured to switch the flow directions of the heat-source-side refrigerant by control of the opening and closing.

Each of the opening and closing devices 17*c* to 17*f* is constituted by, for example, a two-way valve and is configured to open and close the refrigerant pipes 4. The opening and closing device 17*c* is provided in the refrigerant pipe 4(3) in the relay unit 3B and is configured to open and close the refrigerant pipe 4(3). The opening and closing device 17*d* is provided in the refrigerant pipe 4(2) in the relay unit 3B and is configured to open and close the refrigerant pipe 4(2). The opening and closing device 17*e* is provided in the refrigerant pipe 4(1) in the relay unit 3B and is configured to open and close the refrigerant pipe 4(1). The opening and closing device 17*f* is provided in the branch pipe connecting the refrigerant pipe 4(1) and the refrigerant pipe 4(2) in the relay unit 3B and is configured to open and close this branch pipe. The opening and closing device 17*e* and the opening and closing device 17*f* allow the refrigerant to flow into the heat source side heat exchanger 12 in the outdoor unit 1B.

Operation modes carried out by the air-conditioning apparatus 100B will be described in brief below with reference to FIG. 11. Furthermore, since the flow of the heat medium in the heat medium circuit B is the same as that in the air-conditioning apparatus 100, explanation is omitted.

[Cooling Only Operation Mode]

In this cooling only operation mode, control is performed such that the flow switching unit 41 is closed, the flow switching unit 42 is opened, the opening and closing device 17*b* is closed, the opening and closing device 17*c* is closed, the opening and closing device 17*d* is opened, the opening and closing device 17*e* is opened, and the opening and closing device 17*f* is closed.

A low-temperature low-pressure refrigerant is compressed by the compressor 10 and is discharged as a high-temperature high-pressure gas refrigerant therefrom. The whole of the high-temperature high-pressure gas refrigerant discharged from the compressor 10 flows into the heat source side heat exchanger 12 through the flow switching unit 42. The refrigerant condenses into a high-pressure liquid refrigerant in the heat source side heat exchanger 12 while transferring heat to the outdoor air. The high-pressure liquid refrigerant flowing out of the heat source side heat exchanger 12 passes through the refrigerant pipe 4(2) and flows into the relay unit 3B. The high-pressure liquid refrigerant flowing into the relay unit 3B is branched and expanded into a low-temperature low-pressure two-phase refrigerant through the expansion device 16*a* and the expansion device 16*b*.

This two-phase refrigerant flows into each of the heat exchanger related to heat medium 15*a* and the heat exchanger related to heat medium 15*b*, functioning as evaporators, takes heat away from the heat medium circulating in the heat medium circuit B to cool the heat medium, and thus turns into a low-temperature low-pressure gas refrigerant. The gas refrigerant flowing out of the heat exchanger related to heat medium 15*a* and that flowing out of the heat exchanger related to heat medium 15*b* pass through the second refrigerant flow switching device 18*a* and the second refrigerant flow switching device 18*b*, respectively, and then merge together. The resultant refrigerant passes through the opening and closing device 17*e*, flows out of the relay unit 3B, passes through the refrigerant pipe 4(1), and again flows into the outdoor unit 1B. The refrigerant flowing into the outdoor unit 1B is again sucked into the compressor 10 through the accumulator 19.

[Heating Only Operation Mode]

In this heating only operation mode, control is performed such that the flow switching unit 41 is opened, the flow switching unit 42 is closed, the opening and closing device 17*b* is closed, the opening and closing device 17*c* is opened, the opening and closing device 17*d* is opened, the opening and closing device 17*e* is closed, and the opening and closing device 17*f* is closed.

A low-temperature low-pressure refrigerant is compressed by the compressor 10 and is discharged as a high-temperature high-pressure gas refrigerant therefrom. The whole of the high-temperature high-pressure gas refrigerant discharged from the compressor 10 passes through the refrigerant pipe 4(3) and flows out of the outdoor unit 1B. The high-temperature high-pressure gas refrigerant flowing out of the outdoor unit 1B passes through the refrigerant pipe 4(3) and flows into the relay unit 3B. The high-temperature high-pressure gas refrigerant flowing into the relay unit 3B is branched. The refrigerant passes through each of the second refrigerant flow switching device 18*a* and the second refrigerant flow switching device 18*b* and flows into the corresponding heat exchanger related to heat medium 15*a* and the heat exchanger related to heat medium 15*b*.

The high-temperature high-pressure gas refrigerant flowing into each of the heat exchanger related to heat medium 15*a* and the heat exchanger related to heat medium 15*b* condenses and liquefies into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure two-phase refrigerant through the expansion device 16*a* and the expansion device 16*b*. This two-phase refrigerant passes through the opening and closing device 17*d*, flows out of the relay unit 3B, passes through the refrigerant pipe 4(2), and again flows into the outdoor unit 1B.

The refrigerant flowing into the outdoor unit 1B flows into the heat source side heat exchanger 12, functioning as an evaporator. The refrigerant flowing into the heat source side heat exchanger 12 takes heat away from the outdoor air in the heat source side heat exchanger 12 and thus turns into a low-temperature low-pressure gas refrigerant. The low-temperature low-pressure gas refrigerant flowing out of the heat source side heat exchanger 12 passes through the flow switching unit 41 and the accumulator 19, and is again sucked into the compressor 10.

[Cooling-Main Operation Mode]

The cooling-main operation mode will be described with respect to a case in which a cooling load occurs in the use side heat exchanger 26*a* and a heating load occurs in the use side heat exchanger 26*b*. Note that in the cooling-main operation mode, control is performed such that the flow switching unit 41 is closed, the flow switching unit 42 is opened, the opening and closing device 17*b* is opened, the opening and closing device 17*c* is closed, the opening and closing device 17*d* is closed, the opening and closing device 17*e* is opened, and the opening and closing device 17*f* is closed.

A low-temperature low-pressure refrigerant is compressed by the compressor 10 and is discharged as a high-temperature high-pressure gas refrigerant therefrom. The whole of the high-temperature high-pressure gas refrigerant discharged from the compressor 10 flows through the flow switching unit 42 into the heat source side heat exchanger 12. The refrigerant condenses into a two-phase refrigerant in the heat source side heat exchanger 12 while transferring heat to the outside air. The two-phase refrigerant, which has flowed out of the heat source side heat exchanger 12, passes through the refrigerant pipe 4(2) and flows into the relay unit 3B. The two-phase refrigerant flowing into the relay unit 3B passes through the opening and closing device 17*b* and the second refrigerant flow switching device 18*b* and flows into the heat exchanger related to heat medium 15*b*, functioning as a condenser.

The two-phase refrigerant flowing into the heat exchanger related to heat medium 15*b* condenses into a liquid refrigerant while transferring heat to the heat medium circulating in the heat medium circuit B. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* takes heat away from the heat medium circulating in the heat medium circuit B to cool the heat medium, and turns into a low-pressure gas refrigerant. This gas refrigerant flows out of the heat exchanger related to heat medium 15*a*, flows out of the relay unit 3B through the second refrigerant flow switching device 18*a* and the opening and closing device 17*e*, passes through the refrigerant pipe 4(1), and again flows into the outdoor unit 1B. The refrigerant flowing into the outdoor unit 1B passes through the accumulator 19 and is then again sucked into the compressor 10.

[Heating-Main Operation Mode]

The heating-main operation mode will be described with respect to a case in which a heating load occurs in the use side heat exchanger 26*a* and a cooling load occurs in the use side heat exchanger 26*b*. Note that in the heating-main operation mode, control is performed such that the flow switching unit 41 is opened, the flow switching unit 42 is closed, the opening and closing device 17*b* is closed, the opening and closing device 17*c* is opened, the opening and closing device 17*d* is closed, the opening and closing device 17*e* is closed, and the opening and closing device 17*f* is opened.

A low-temperature low-pressure refrigerant is compressed by the compressor 10 and is discharged as a high-temperature high-pressure gas refrigerant therefrom. The whole of the high-temperature high-pressure gas refrigerant discharged from the compressor 10 passes through the refrigerant pipe 4(3) and flows out of the outdoor unit 1B. The high-temperature high-pressure gas refrigerant flowing out of the outdoor unit 1B passes through the refrigerant pipe 4(3) and flows into the relay unit 3B. The high-temperature high-pressure gas refrigerant flowing into the relay unit 3B passes through the opening and closing device 17*c* and the second refrigerant flow switching device 18*b* and flows into the heat exchanger related to heat medium 15*b*, functioning as a condenser.

The gas refrigerant flowing into the heat exchanger related to heat medium 15*b* condenses into a liquid refrigerant while transferring heat to the heat medium circulating in the heat medium circuit B. The liquid refrigerant flowing out of the heat exchanger related to heat medium 15*b* is expanded into a low-temperature low-pressure two-phase refrigerant by the expansion device 16*b*. This low-temperature low-pressure two-phase refrigerant flows through the expansion device 16*a* into the heat exchanger related to heat medium 15*a*, functioning as an evaporator. The low-temperature low-pressure two-phase refrigerant flowing into the heat exchanger related to heat medium 15*a* takes heat away from the heat medium circulating in the heat medium circuit B to evaporate, and cools the heat medium. This low-temperature low-pressure two-phase refrigerant flows out of the heat exchanger related to heat medium 15*a*, passes through the second refrigerant flow switching device 18*a* and the opening and closing device 17*f*, flows out of the relay unit 3B, passes through the refrigerant pipe 4(2), and again flows into the outdoor unit 1B.

The refrigerant flowing into the outdoor unit 1B flows into the heat source side heat exchanger 12, functioning as an evaporator. The refrigerant flowing into the heat source side heat exchanger 12 takes heat away from the outdoor air in the heat source side heat exchanger 12 and turns into a low-temperature low-pressure gas refrigerant. The low-temperature low-pressure gas refrigerant flowing out of the heat source side heat exchanger 12 is again sucked into the compressor 10 through the flow switching unit 41 and the accumulator 19.

It should be noted that each of the first heat medium flow switching devices 22 and the second heat medium flow switching devices 23 described in the Embodiment may be any component as long as it can switch flow paths, such as a three-way valve which can switch a three-way flow or a combination of, for example, two on-off valves that can close and open a two-way flow. Alternatively, as each of the first heat medium flow switching devices 22 and the second heat medium flow switching devices 23, components such as a stepping-motor-driven mixing valve capable of changing a flow rate of the three-way flow or a combination of, for example, electronic expansion valves capable of changing a flow rate of the two-way flow may be used. In this case, water hammer caused when a flow path is suddenly opened or closed can be prevented. Furthermore, the Embodiment has been described with respect to the case in which each of the heat medium flow rate control devices 25 is constituted by a stepping-motor-driven two-way valve. However, each of the heat medium flow rate control devices 25 may be constituted by a control valve having a three-way flow and the valve may be disposed with a bypass pipe that bypasses the corresponding use side heat exchanger 26.

Figure 8:
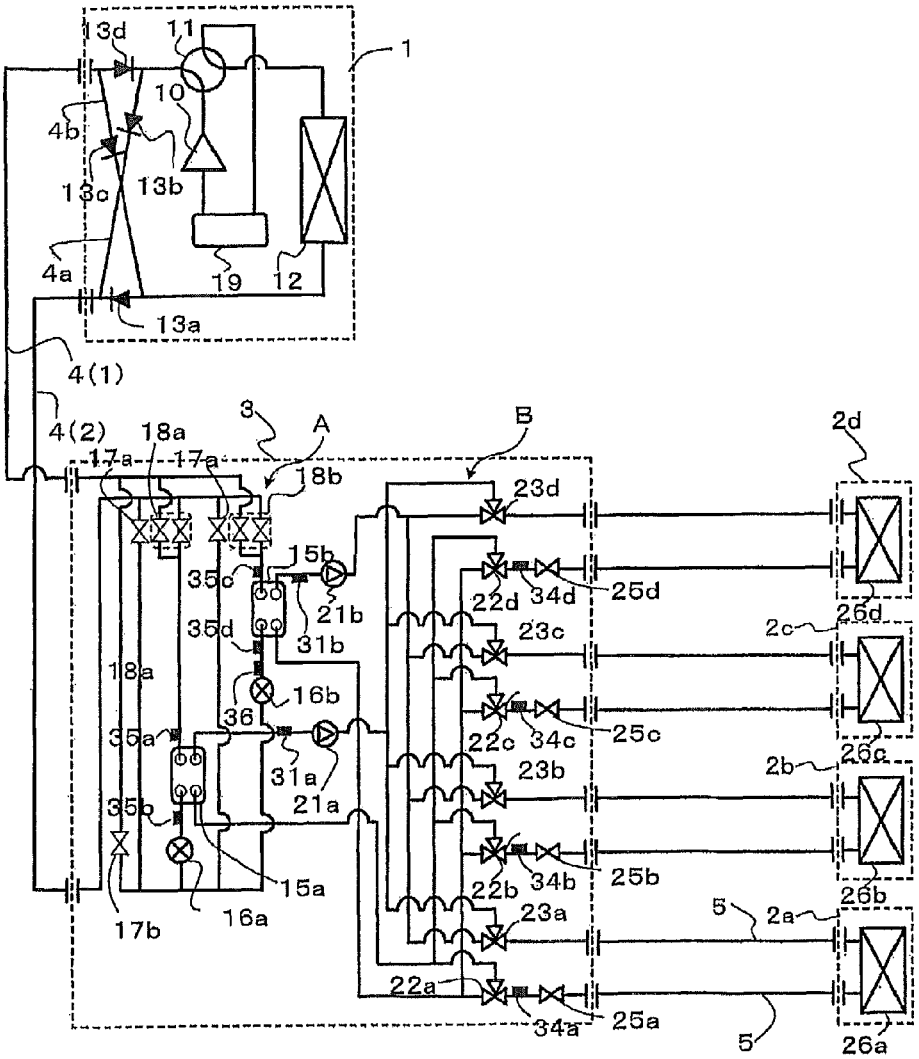
FIG. 8 is a schematic circuit diagram illustrating another configuration of the air-conditioning apparatus according to the Embodiment of the invention.

Furthermore, although each second refrigerant flow switching device 18 is depicted as a four-way valve, it is not limited to this and may include a plurality of two-flow-path switching valves or three-flow-path switching valves such that the refrigerant flows in the same manner. That is, even if two two-flow-path switching valves are used in place of the second refrigerant flow switching device 18*a* and two two-flow-path switching valves are used in place of the second refrigerant flow switching device 18*b* as illustrated in FIG. 8, the same advantages are achieved. Moreover, although the opening and closing means 17*a* and the second refrigerant flow switching device 18*a* are depicted such that they are arranged in different positions, the arrangement is not limited to this. A plurality of opening and closing means 17*a* may be provided and may be arranged near the respective second refrigerant flow switching devices 18 (refer to FIG. 8).

Figure 9:
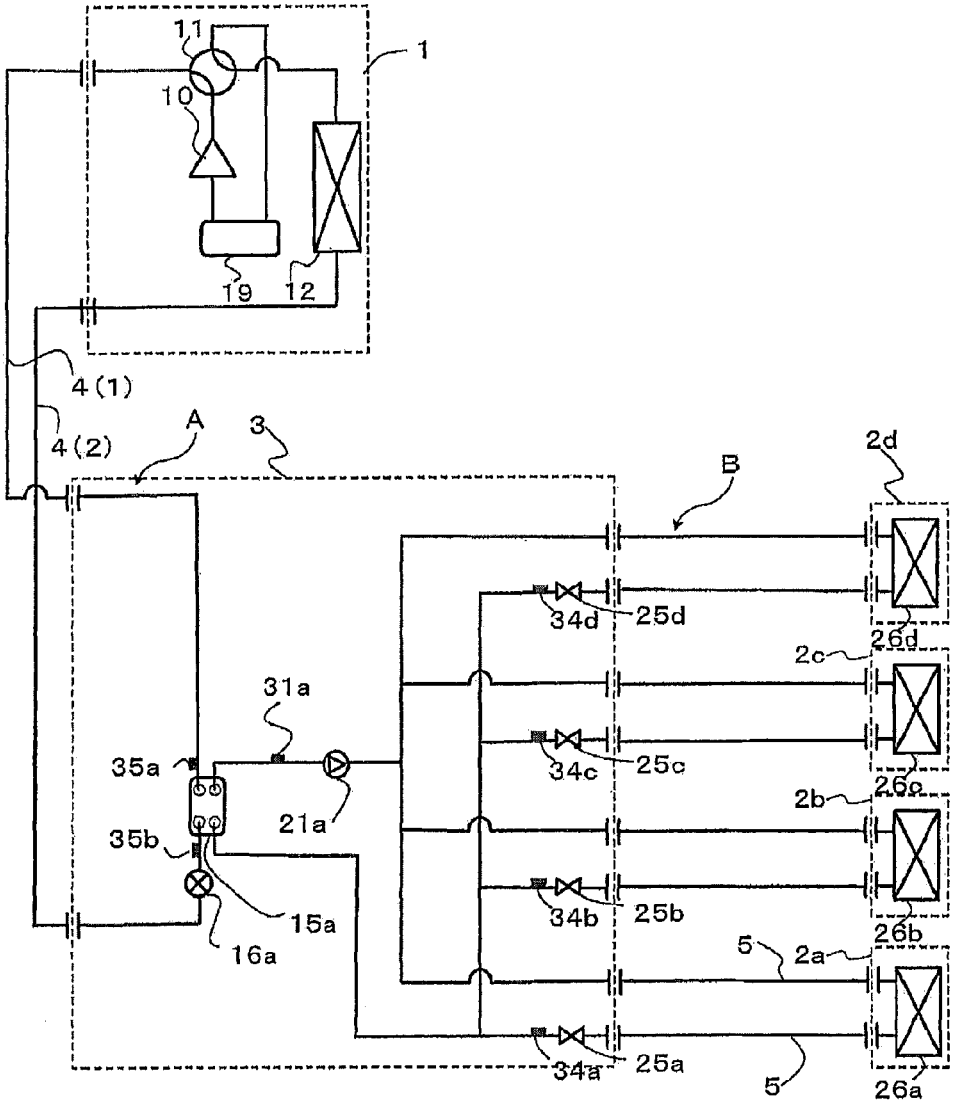
FIG. 9 is a schematic circuit diagram illustrating yet another configuration of the air-conditioning apparatus according to the Embodiment of the invention.

The air-conditioning apparatus 100 according to the Embodiment has been described on the assumption that it can perform the cooling and heating mixed operation but it is not limited to this case. For example, if the air-conditioning apparatus 100 is configured such that, as illustrated in FIG. 9, a single heat exchanger related to heat medium 15 and a single expansion device 16 are arranged, a plurality of use side heat exchangers 26 and a plurality of heat medium flow rate control valves 25 are connected in parallel to them, and either the cooling operation or the heating operation can be performed, the sizes of the pipes may be similarly determined. With this configuration, the relationship between the inner cross-sectional areas of the refrigerant pipes 4 connecting the outdoor unit 1 and the relay unit 3 and that of each pipe 5 connecting the relay unit 3 and each indoor unit 2 holds in the same way as that described above and the same advantages are achieved.

Moreover, it is needless to say that the same relationship holds if a single use side heat exchanger 26 and a single heat medium flow rate control valve 25 are connected. Moreover, naturally, it is not a problem to arrange a plurality of components acting in the same way as each of the heat exchanger related to heat medium 15 and the expansion device 16. Furthermore, although the heat medium flow rate control valves 25 have been described with respect to the case in which they are arranged in the relay unit 3, the arrangement is not limited to this case. The heat medium flow rate control valves 25 may be arranged in the indoor units 2. The relay unit 3 may be separated from the indoor units 2.

As regards the heat-source-side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, and a mixture containing the refrigerant, or a natural refrigerant, such as $CO_2$ or propane, can be used. In the heat exchanger related to heat medium 15*a* or the heat exchanger related to heat medium 15*b* which operates to heat, a refrigerant that typically changes between two phases condenses into a liquid and a supercritical refrigerant, such as $CO_2$, is cooled in the supercritical state. Except for this, both acts in the same way and achieves the same advantages.

As regards the heat medium, for example, brine (antifreeze), water, a mixed solution of brine and water, or a mixed solution of water and an additive with a high corrosion protection effect can be used. In the air-conditioning apparatus 100, therefore, even if the heat medium leaks through the indoor unit 2 into the indoor space 7, the safety of the used heat medium is high. Accordingly, it contributes to safety improvement.

The Embodiment has been described with respect to the case in which the air-conditioning apparatus 100 includes the accumulator 19. The accumulator 19 may be omitted. Furthermore, the Embodiment has been described with respect to the case in which the air-conditioning apparatus 100 includes the check valves 13*a* to 13*d*. These components are not essential parts. It is therefore needless to say that even if the accumulator 19 and the check valves 13*a* to 13*d* are not disposed, the apparatus acts in the same way and achieves the same advantages.

Typically, each of the heat source side heat exchanger 12 and the use side heat exchangers 26 is provided with a fan in which current of air often facilitates condensation or evaporation. The structure is not limited to this case. For example, a heat exchanger, such as a panel heater, using emission can be used as the use side heat exchanger 26 and a water-cooled type heat exchanger which transfers heat using water or antifreeze can be used as the heat source side heat exchanger 12. In other words, heat exchangers configured to be capable of transferring heat or taking heat away can be used as the heat source side heat exchanger 12 and the use side heat exchanger 26 regardless of kind. Moreover, the number of use side heat exchangers 26 is not limited in particular.

The Embodiment has been described with respect to the case in which one first heat medium flow switching device 22, one second heat medium flow switching device 23, and one heat medium flow rate control device 25 are connected to each use side heat exchanger 26. The arrangement is not limited to this case. A plurality of devices 22, devices 23, and devices 25 may be connected to each use side heat exchanger 26. In this case, the first heat medium flow switching devices, the second heat medium flow switching devices, and the heat medium flow rate control devices connected to the same use side heat exchanger 26 may be similarly operated.

Furthermore, the Embodiment has been described with respect to the case in which the number of heat exchangers related to heat medium 15 is two. As a matter of course, the arrangement is not limited to this case. As long as the heat exchanger related to heat medium 15 is configured to be capable of cooling or/and heating the heat medium, the number of arranged heat exchangers related to heat medium 15 is not limited. Furthermore, each of the number of pumps 21*a* and that of pumps 21*b* is not limited to one. A plurality of small capacity pumps may be used in parallel.

As described above, the air-conditioning apparatus 100 according to the Embodiment can perform a safe and high energy-saving operation by controlling the heat medium flow switching devices (the first heat medium flow switching devices 22 and the second heat medium flow switching devices 23), the heat medium flow rate control devices 25, and the pumps 21 for the heat medium.

REFERENCE SIGNS LIST

1 outdoor unit; 1B outdoor unit; 2 indoor unit; 2*a* indoor unit; 2*b* indoor unit; 2*c* indoor unit; 2*d* indoor unit; 3 relay unit; 3B relay unit; 3*a* main relay unit; 3*b* sub relay unit; 4 refrigerant pipe; 4*a* first connecting pipe; 4*b* second connecting pipe; 5 pipe; 6 outdoor space; 7 indoor space; 8 space; 9 structure; 10 compressor; 11 first refrigerant flow switching device; 12 heat source side heat exchanger; 13*a* check valve; 13*b* check valve, 13*c* check valve; 13*d* check valve; 14 gas-liquid separator; 15 heat exchanger related to heat medium; 15*a* heat exchanger related to heat medium; 15*b* heat exchanger related to heat medium; 16 expansion device; 16 an expansion device; 16*b* expansion device; 16*c* expansion device; 17 opening and closing device; 17*a* opening and closing device; 17*b* opening and closing device; 17*c* opening and closing device; 17*d* opening and closing device; 17*e* opening and closing device; 17*f* opening and closing device; 18 second refrigerant flow switching device; 18*a* second refrigerant flow switching device; 18*b* second refrigerant flow switching device; 19 accumulator; 21 pump; 21*a* pump; 21*b* pump; 22 first heat medium flow switching device; 22*a* first heat medium flow switching device; 22*b* first heat medium flow switching device; 22*c* first heat medium flow switching device; 22*d* first heat medium flow switching device; 23 second heat medium flow switching device; 23*a* second heat medium flow switching device; 23*b* second heat medium flow switching device; 23*c* second heat medium flow switching device; 23*d* second heat medium flow switching device; 25 heat medium flow rate control device; 25*a* heat medium flow rate control device; 25*b* heat medium flow rate control device; 25*c* heat medium flow rate control device; 25*d* heat medium flow rate control device; 26 use side heat exchanger; 26*a* use side heat exchanger; 26*b* use side heat exchanger; 26*c* use side heat exchanger; 26*d* use side heat exchanger; 31 first temperature sensor; 31*a* first temperature sensor; 31*b* first temperature sensor; 34 second temperature sensor; 34*a* second temperature sensor; 34*b* second temperature sensor; 34*c* second temperature sensor; 34*d* second temperature sensor; 35 third temperature sensor; 35*a* third temperature sensor; 35*b* third temperature sensor; 35*c* third temperature sensor; 35*d* third temperature sensor; 36 pressure sensor; 41 flow switching unit; 42 flow switching unit; 100 air-conditioning apparatus; 100A air-conditioning apparatus; 100B air-conditioning apparatus; A refrigerant circuit; and B heat medium circuit.

The invention claimed is:

1. An air-conditioning apparatus comprising:

a compressor; a heat source side heat exchanger; an expansion device; a heat exchanger related to heat medium; a pump; and a plurality of use side heat exchangers, the compressor, the heat source side heat exchanger, the expansion device, and the heat exchanger related to heat medium being connected with refrigerant pipes to form a refrigerant circuit in which a heat-source-side refrigerant is circulated, the pump, the plurality of use side heat exchangers, and the heat exchanger related to heat medium being connected with heat medium pipes to form a heat medium circuit in which a heat medium is circulated, the compressor and the heat source side heat exchanger being housed in an outdoor unit, the expansion device, the heat exchanger related to heat medium, and the pump being housed in a relay unit, each of the plurality of use side heat exchangers being housed in an indoor unit, the heat exchanger related to heat medium exchanging heat between the heat-source-side refrigerant and the heat medium, wherein the refrigerant pipes are configured such that an inner cross-sectional area of a refrigerant pipe among the refrigerant pipes, which connects between the outdoor unit and the relay unit and through which a high-pressure refrigerant flows, is smaller than an inner cross-sectional area of a refrigerant pipe among the refrigerant pipes, which connects the outdoor unit and the relay unit and through which a low-pressure refrigerant flows, a heat medium pipe among the heat medium pipes, which connects the relay unit and the indoor unit, is configured such that each inner cross-sectional area of the heat medium pipe per 1 kW of capacity of the plurality of the indoor units is larger than the inner cross-sectional area per 1 kW of the outdoor unit capacity of the refrigerant pipe through which the low-pressure refrigerant flows for retarding corrosion.

2. The air-conditioning apparatus of claim 1, wherein each inner cross-sectional area of the heat pipe connecting the relay unit and the indoor unit per 1 kW of capacity of the plurality of the indoor units is two or more times larger than the inner cross-sectional area per 1 kW of the outdoor unit capacity of the refrigerant pipe through which the low-pressure refrigerant flows.

3. The air-conditioning apparatus of claim 1, wherein a heat medium flow rate control device controlling the rate of circulation of the heat medium is disposed at an inlet or an outlet of a heat medium flow path of the use side heat exchanger, and the use side heat exchanger and the heat medium flow rate control device are connected to the heat exchanger related to heat medium.

4. The air-conditioning apparatus of claim 1, wherein the expansion device and the heat exchanger related to heat medium are provided in plural numbers.

5. The air-conditioning apparatus of claim 4, wherein the use side heat exchanger is one of a plurality of use side heat exchangers arranged in parallel, the apparatus has a cooling and heating mixed operation mode in which a high-temperature high-pressure heat-source-side refrigerant discharged from the compressor flows into one of the heat exchangers related to heat medium to heat the heat medium and a low-temperature low-pressure heat-source-side refrigerant flows into another one of the heat exchangers related to heat medium to cool the heat medium such that each use side heat exchanger is allowed to perform a cooling operation or a heating operation, and one of the expansion devices is disposed on an outlet side of the heat exchanger related to heat medium on the heating side in the cooling and heating mixed operation mode and another one of the expansion devices is disposed on an inlet side of the heat exchanger related to heat medium on the cooling side in the cooling and heating mixed operation mode.

6. The air-conditioning apparatus of claim 1, wherein the outdoor unit is connected to the relay unit through two refrigerant pipes and the relay unit is connected to each indoor unit through two heat medium pipes.

* * * * *